US007762031B2

(12) United States Patent
Leek et al.

(10) Patent No.: US 7,762,031 B2
(45) **Date of Patent: *Jul. 27, 2010**

(54) STRAP HOLD DOWN WITH RESTRAINT OPENING

(75) Inventors: William F. Leek, Carmel, CA (US); Michael G. Wagner, Las Vegas, NV (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 1648 days.

This patent is subject to a terminal disclaimer.

(21) Appl. No.: 10/871,333

(22) Filed: Jun. 18, 2004

(65) Prior Publication Data

US 2005/0279048 A1 Dec. 22, 2005

(51) Int. Cl.
*E02D 27/01* (2006.01)
*E04B 1/38* (2006.01)

(52) U.S. Cl. ..... 52/295; 52/699; 52/712; 52/745.21; 249/93

(58) Field of Classification Search ..... 52/295, 52/699, 712, 714, 745.21; 411/107, 480; 248/547; 403/13, 14; 249/34, 219.1, 91, 249/93

See application file for complete search history.

(56) References Cited

U.S. PATENT DOCUMENTS

| | | | | | |
|---|---|---|---|---|---|
| 98,438 | A | * | 12/1869 | Smith | 411/480 |
| 831,179 | A | * | 9/1906 | McDonagh | 16/4 |
| 972,618 | A | * | 10/1910 | Haag | 249/22 |
| 1,406,723 | A | * | 2/1922 | Caldwell | 403/232.1 |
| 1,873,731 | A | | 8/1932 | Zingali | |
| 1,886,921 | A | * | 11/1932 | Tobin | 182/117 |
| 1,985,333 | A | * | 12/1934 | Wiley | 411/107 |
| 2,004,635 | A | * | 6/1935 | Price | 40/615 |
| 2,379,595 | A | * | 7/1945 | Roe | 52/384 |
| 2,379,752 | A | * | 7/1945 | Schultz | 403/299 |
| 2,501,474 | A | * | 3/1950 | Martin | 40/202 |
| 2,567,903 | A | * | 9/1951 | Bedford, Jr. | 24/293 |
| 2,838,822 | A | * | 6/1958 | Kenney et al. | 52/127.3 |
| 2,916,115 | A | * | 12/1959 | Van Niel et al. | 403/14 |
| 3,074,680 | A | * | 1/1963 | Stewart | 248/470 |
| 3,141,532 | A | * | 7/1964 | Runyan | 52/105 |

(Continued)

OTHER PUBLICATIONS

Miscellaneous Hardware. KANT-SAG Construction Hardware Full Line Catalog, Jul. 1984, pp. 44-45. United Steel Products Company. Montgomery, Minn.

(Continued)

*Primary Examiner*—Robert J Canfield
(74) *Attorney, Agent, or Firm*—James R. Cypher; Charles R. Cypher

(57) ABSTRACT

A connection between a first structural member and a second structural member by a separate structural connector is provided where the second structural member has a first surface from which a fastener protrudes, and the fastener has a relatively narrow shank and a head that is wider than the shank attached to the shank, the head being held away from the first surface of the second structural member, the head also having a top surface and a bottom surface, and the connector is formed with at least one restraint opening therethrough, the restraint opening being formed to have a first ledge and a second ledge that are spaced apart and the head of the fastener is inserted between the first ledge and the second ledge.

13 Claims, 25 Drawing Sheets

U.S. PATENT DOCUMENTS 3,156,282 A * 11/1964 Bedford, Jr. ..... 411/103
3,170,028 A * 2/1965 Otten ..... 174/58
3,279,518 A * 10/1966 Bollinger ..... 411/166
3,325,852 A * 6/1967 Hill ..... 16/16
3,430,674 A * 3/1969 Forbush ..... 411/107
3,491,820 A * 1/1970 Ostling ..... 52/796.1
3,750,360 A * 8/1973 Kingston ..... 52/714
3,771,275 A * 11/1973 Seckerson ..... 52/508
3,788,026 A * 1/1974 Cook ..... 52/127.2
3,983,779 A * 10/1976 Dimas ..... 411/447
3,998,026 A * 12/1976 Allen ..... 52/714
4,067,168 A * 1/1978 Thurner ..... 52/854
4,083,525 A * 4/1978 Rath ..... 248/496
4,192,118 A * 3/1980 Gilb ..... 52/714
4,202,149 A 5/1980 Betrue
4,291,996 A * 9/1981 Gilb ..... 403/14
4,344,604 A 8/1982 Basey
4,349,706 A * 9/1982 Thompson ..... 379/454
4,404,781 A * 9/1983 Gilb ..... 52/295
4,413,456 A * 11/1983 Gilb ..... 52/295
4,480,941 A * 11/1984 Gilb et al. ..... 403/232.1
4,570,403 A * 2/1986 Dannemiller ..... 52/295
4,587,788 A 5/1986 Bielicki
4,739,598 A * 4/1988 Jensen et al. ..... 52/295
4,846,615 A 7/1989 Forsyth
4,896,985 A * 1/1990 Commins ..... 403/11
4,932,105 A 6/1990 Muller
4,943,023 A 7/1990 Becker
5,004,369 A * 4/1991 Young ..... 403/232.1
5,020,761 A * 6/1991 Good et al. ..... 248/317
5,048,999 A 9/1991 Wurl
5,071,280 A * 12/1991 Turner ..... 403/232.1
5,150,553 A * 9/1992 Commins et al. ..... 52/264
5,217,317 A * 6/1993 Young ..... 403/232.1
5,295,754 A 3/1994 Kato
5,390,455 A 2/1995 Antolini
5,407,182 A 4/1995 Hartley
5,564,248 A * 10/1996 Callies ..... 52/702
5,577,301 A * 11/1996 De Maagd ..... 24/295
5,595,031 A * 1/1997 Commins ..... 52/264
5,603,580 A * 2/1997 Leek et al. ..... 403/232.1
5,670,076 A * 9/1997 Leek ..... 249/53 M
5,794,395 A * 8/1998 Reed ..... 52/298
5,813,182 A * 9/1998 Commins ..... 52/295
5,826,466 A * 10/1998 Weissbach ..... 81/26
5,897,082 A * 4/1999 Losada ..... 248/65
6,029,765 A * 2/2000 Chou et al. ..... 180/292
6,062,789 A 5/2000 Pope
6,523,321 B1 * 2/2003 Leek et al. ..... 52/702
6,658,806 B1 12/2003 Leek
6,796,099 B1 * 9/2004 Georges et al. ..... 52/699
2004/0040236 A1 * 3/2004 Adams ..... 52/293.3
2006/0191233 A1 * 8/2006 Tamlyn ..... 52/702

OTHER PUBLICATIONS

Bulldog-Simpson GMBH, 'Statische Berechnungen Simpson-HRB-Verbinder Bulldog-Simpson GmbH (Germany), p. 1-3, (Nov. 1998).

Advanced Connector Systems, "AFS Form Shoe," AFS Form Shoe Pamphlet, Advanced Connector Systems (Phoenix, Arizona), p. 1-3, (1996).

Symons Corporation, "Concrete Forming System," Concrete Forming System Brochure, Symons Corporation (Des Plaines, Illinois), p. 1-24, (1994).

Simpson Strong-Tie Company, Inc., "PAHD/MPAHD/HP AHD Holdowns," Catalog C-95H-1, Simpson Strong-Tie Company, Inc. (Pleasanton, California), p. 18-19, (1995).

Simpson Strong-Tie Company, Inc., "MASB/MAS/MAB/MA Mudsill Anchors, " Catalog C-98, Simpson Strong-Tie Company, Inc. (Pleasanton, California), p. 9 (1997).

Simpson Strong-Tie Company, Inc., "MKP Monkey Paw Anchor Bolt Holders," catalog C-98, Simpson Strong-Tie Company, Inc. (Pleasanton, California), p. 21, (1997).

Simpson Strong-Tie Company, Inc., "LSTHD/STHD Strap Tie Holder," catalog C-2001, Simpson Strong-Tie Company, Inc. (Dublin, California), p. 28. (2001).

* cited by examiner

STRAP HOLD DOWN WITH RESTRAINT OPENING

BACKGROUND OF THE INVENTION

The present invention relates to securing a planar portion of a connector to a structural or supporting member by means of a specialized fastener opening, herein termed a "restraint opening" and a conventional fastener having a head and a shank.

The present invention finds particular use in temporarily securing an elongate connector that anchors a vertically-disposed structural member to a concrete foundation. The connector is typically called a strap anchor and by being partially embedded in a concrete foundation and attached to a structural member that is to be anchored, such as a wall stud, it anchors the wall stud.

According to the present invention, the embedded portion of the anchor has a specially-formed restraint opening that, in the preferred embodiments, can receive and hold the head of a standard single-headed fastener, especially a nail. The opening is located in the embedded portion of the connector such that the nail can be aligned with the opening and partially driven into a wooden form board or other member. A form board, as used here, is a temporary structural member that is used to define the boundaries of a poured concrete foundation or other cementitious member. By connecting the single-headed nail to the connector and to the form board, the nail serves as a brace for the connector. This helps to keep the connector plumb during the concrete pour.

The connector alignment can be adjusted after the nail head and restraint opening have been interlocked because the nail can be adjusted by being pushed in, pulled out, or aligned while remaining strong enough to serve as an effective brace.

As evidenced by such prior patents as U.S. Pat. No. 5,150,553, granted to Alfred D. Commins on Sep. 29, 1992 and U.S. Pat. No. 5,813,182, granted to Alfred D. Commins, on Sep. 29, 1998, connectors that are partially embedded in a concrete foundation and attached to vertically-disposed structural members by means of fasteners are well-known in the prior art. U.S. Pat. Nos. 5,150,553 and 5,813,182 are incorporated herein by reference. These connectors, commonly called strap anchors, have been widely accepted by builders due to the ease with which they can be installed, and their relatively low cost as compared to other types of anchors.

Strap anchors, as described above, are generally elongate members. They protrude well above the upper surface of the foundation. Strap anchors are generally designed to be attached with light fasteners such as nails. A large number of nails is generally necessary in order to make a secure attachment between the connector and the vertically-disposed structural member. The upper portion of the connector must therefore be fairly long to accommodate the large numbers of fasteners.

A considerable portion of the strap anchor protrudes above the level of the foundation and this creates problems during the pouring of the concrete around the strap anchor. Generally, strap anchors are attached to the outer form boards near the tops of the form boards by means of typical fasteners such as nails and conventional fastener openings. The inventor has found that during a typical foundation pour, the flowing concrete has a tendency to move the strap anchor out of the alignment it originally had when it was attached to the form board. This is thought to occur because the attachment of the strap anchor to the form board is insufficient.

To improve the connection between the form board and the strap anchor so that the anchor is less likely to be moved out of its original and correct alignment, the inventors have devised an additional attachment between the form board and the strap anchor.

SUMMARY OF THE INVENTION

It is an object of the present invention to provide an attachment mechanism for a structural connector that allows the connector to be selectively spaced from the surface of the structural member to which it is attached. This selective spacing is accomplished by attaching the connector to a fastener that can be set at a selected spacing from the structural member.

It is an object of the present invention to provide a connection between a first structural member and a second structural member by means of a separate structural connector where the second structural member has a first surface from which a fastener protrudes, and the fastener has a relatively narrow shank and a head that is wider than the shank attached to the shank, the head being held away from the first surface of the second structural member, the head also having a top surface and a bottom surface, and the connector is formed with at least one restraint opening therethrough, the restraint opening being formed to have a first ledge and a second ledge that are spaced apart and the head of the fastener is inserted between said first ledge and said second ledge such that said first ledge and said second ledge trap said head of said fastener so that the first ledge interfaces with said bottom surface of the head of the fastener and the second ledge interfaces with the top surface of the head of the fastener; and the first ledge restrains movement of the connector away from the first surface of the second structural member, and the second ledge restrains movement of the substantially planar portion of the connector toward the first surface of the second structural member.

It is a further object of the present invention to design the connection so that the fastener can be a nail with a pointed tip at the opposite end of the shank from the head, and the nail is partially driven into the first surface of the structural member.

It is a further object of the present invention to design the connection so that the first structural member is a cementitious member, the second structural member is a form board and the first surface is an inner surface of a form board, and the cementitious member has an outer surface that is in abutting relationship with the inner surface of the form board and the cementitious member also has a top surface, and the connector additionally has an attachment section that has at least some portion protruding out of the cementitious member and is attached to a foot section, the foot section being attached to the first structural member by being at least partially embedded in the cementitious member.

It is a further object of the present invention to design the connection so that the foot section is substantially planar and further has a first side face and a second side face with the first side face being disposed toward the inner surface of the form board.

It is a further object of the present invention to design the connection so that the foot section substantially planar and further has a first side face and a second side face with the first side face being disposed to ward the inner surface of the form board.

It is further object of the present invention to design the connection so that the foot section further has a top end and a bottom end, and the attachment section is elongated and substantially planar and is integrally connected to the top end of the foot section, and the attachment section is disposed at a selected angle to the foot section, the attachment section further has a plurality of restricted openings that are large enough to receive the shanks of standard nailable fasteners but are too small to receive the heads of standard nailable fasteners, and the connector further comprises a hook section integrally connected to the bottom end of the foot section, the hook section being formed to provide mechanical interlock with the cementitious member.

It is a further object of the present invention to design the connection so that the restraint opening is formed with an embossment and an adjacent aperture and wherein the aperture has a first side and a second side, the first ledge being on the first side of the aperture and the second ledge being on the second side of the aperture, and the said second ledge is in the embossment and out of the plane of the foot section of the connector, and a portion of the head of the fastener is within the embossment and a portion of the head of the fastener is on the second side face of the foot section.

It is a further object of the present invention to design the connection so that the aperture that is part of the restraint opening is arcuate.

It is further object of the present invention to design the connection so that the first side of the arcuate aperture is divided by an open leg that permits the fastener to be driven through the aperture into the second structural member after the connector is placed in a selected position.

It is further object of the present invention to design the connection so that restraint opening is formed with an aperture having a moveable flap, permitting the fastener to be driven through the opening into the second structural member when the flap is open, and after the connector is placed in a selected position, the flap is moved such that the head of the fastener is held between the first ledge and the second ledge when the flap is closed on the head of the fastener, and one of the first and second ledges is located on the flap.

It is a further object of the present invention to provide an improved connection between a connector and a form board from which it is suspended, so that the connector remains in alignment during the pouring of the cementitious member in which it is suspended, and a method of making that connection. This improved connection is achieved by making an additional attachment between the connector and the form board. The additional attachment is made possible by forming the embedded portion of the connector with an opening that can receive and hold the head of a nail, or similar headed fastener, where the head is selectively spaced from the surface of the structural member to which it is attached.

In the preferred form of the invention, when the connector is a strap anchor, the additional attachment by means of the fastener between the connector and the structural member is made with a single-headed nail. The nail head is held by two offset edges that form restraining ledges on two sides of the opening in the embedded portion of the connector, such that one ledge restrains movement of the foot section along the shank of the nail toward its tip and the other ledge restrains movement of the foot section away from the tip of the nail. The two edges of the opening may be different sides of the opening since any round, obround, ovoid or elliptical opening has no corners and, therefore, only one edge.

To make the connection of the present invention, when the connector is a strap anchor, the nail is moved into position by partially driving it into the form board, preferably to a selected depth so that the exposed length and angle of the nail shank corresponds to the correct distance and angle that the foot section of the connector must be held from the surface of the form board. This is preferable, but the nail can be "underdriven" and then adjusted after the foot section of the connector is attached. After the nail is partially driven, the foot section of the connector is moved into place so that the head of the nail is between the two ledges. This is done by moving the nail head past one ledge and then levering it into position so that one ledge is below the nail head and the other ledge is above the nail head. If the nail was "underdriven," it can now be pushed further in with the foot section of the connector attached. This can be done by pushing the foot section of the connector toward the inner surface of the form board and, if necessary, this can be aided by hammering on the foot section over the nail head.

DETAILED DESCRIPTION OF THE INVENTION

Figure 1A:
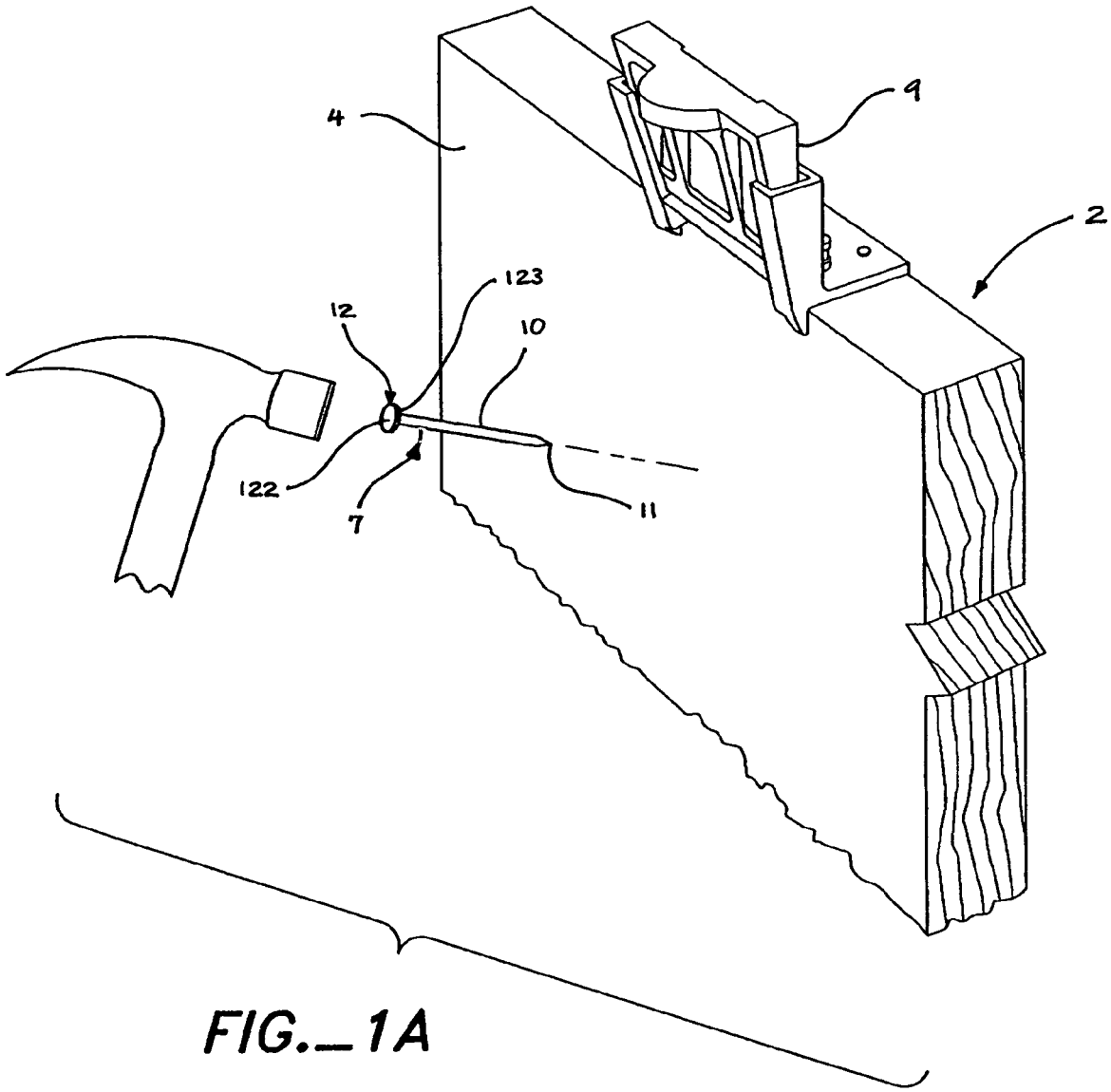
FIG. 1A is a perspective view of a standard nail that is shown ready to be partially driven into the form board.
Figure 1B:
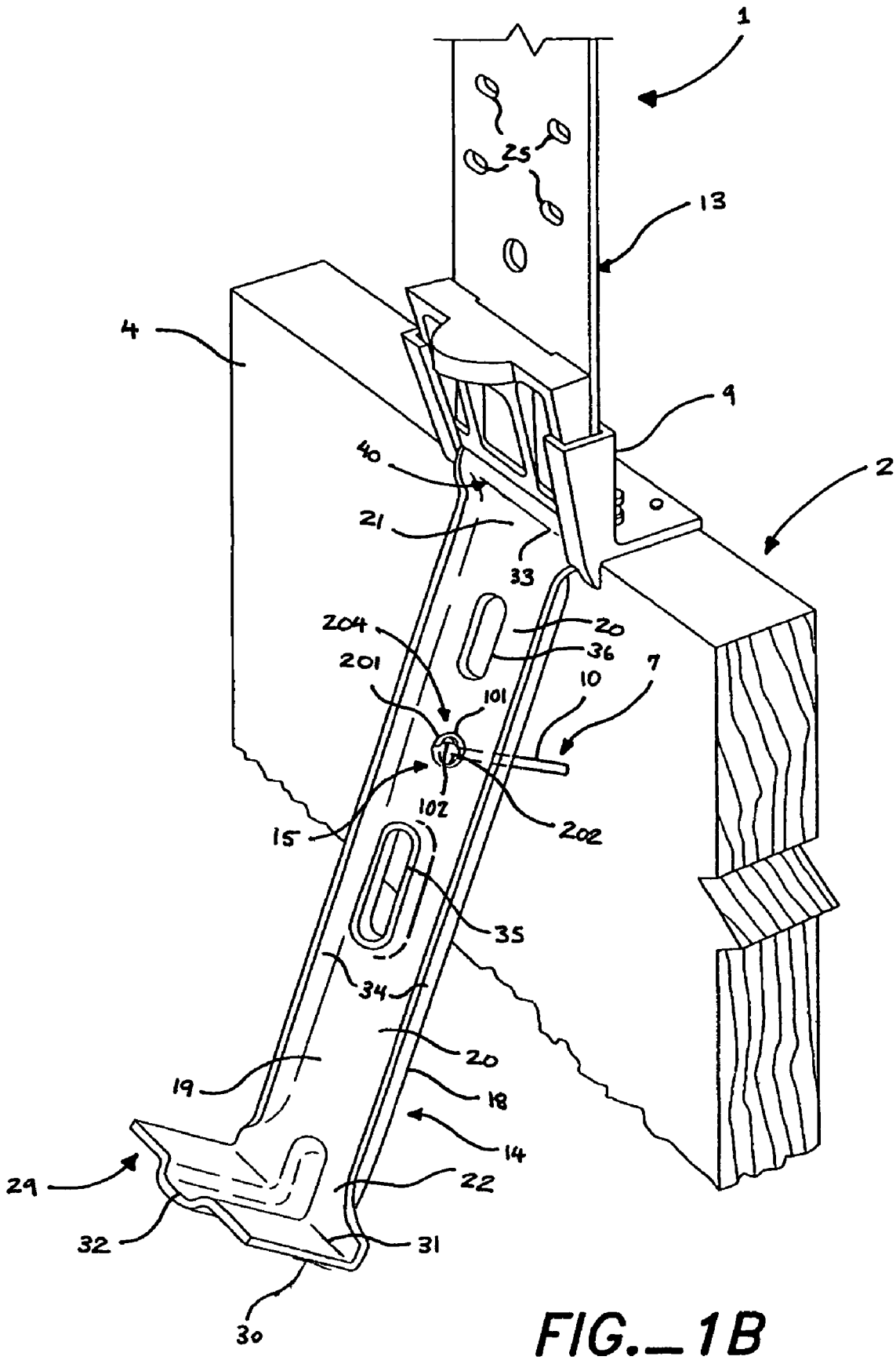
FIG. 1B is a perspective view of a strap anchor suspended from a foundation form board. A nail has been partially hammered into the form board and the nail head is in the cavity formed below the opening of the foot section, the cavity preferably formed by an embossment.
Figure 1C:
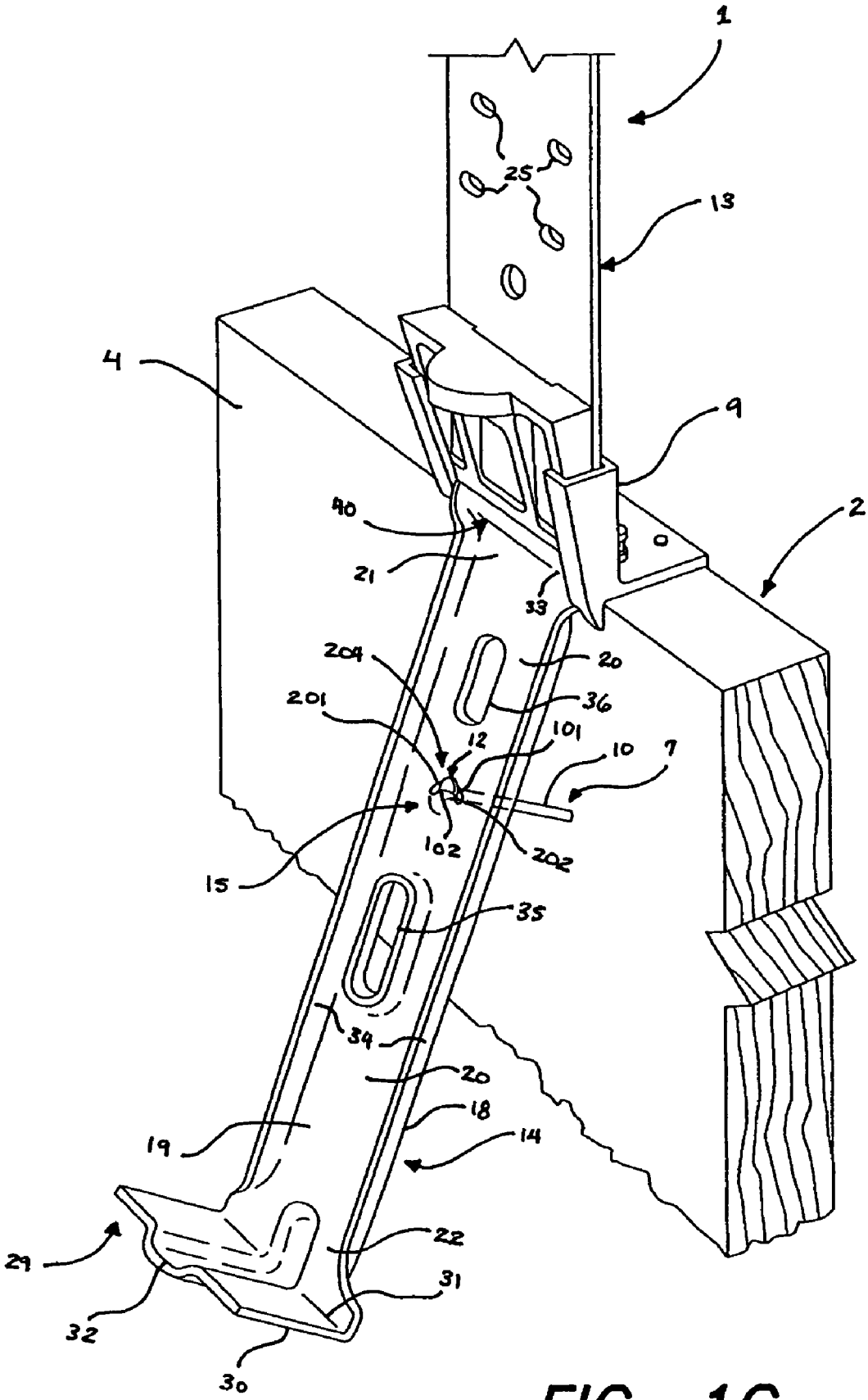
FIG. 1C is a perspective view similar to FIG. 1B except that the head of the nail is shown trapped between the upper and lower edges of the opening in the foot section.
Figure 2:
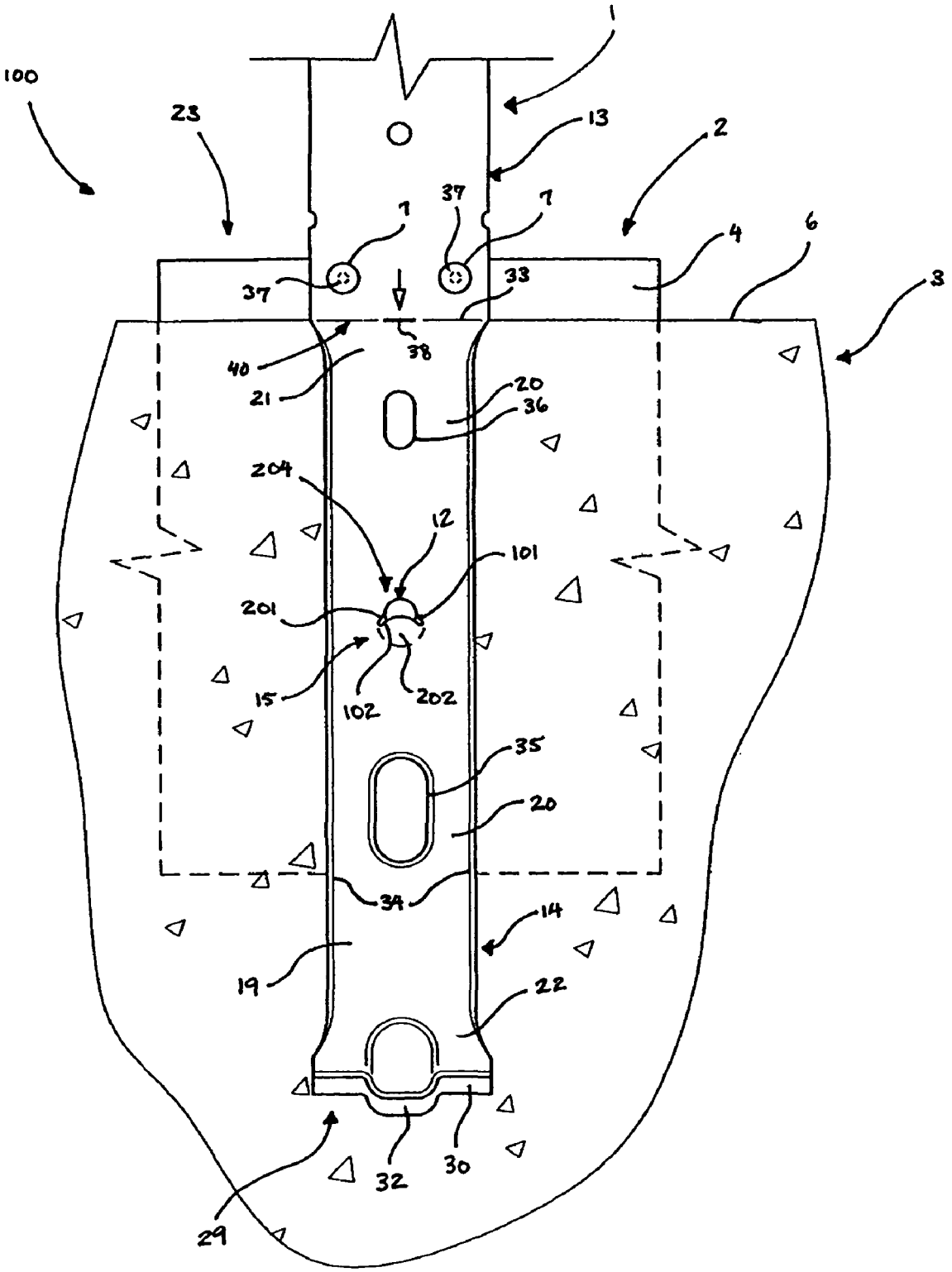
FIG. 2 is a front elevation view of a connector embedded in a foundation. The foot portion of the connector is shown in solid lines although it would be hidden by the foundation. Phantom lines show a portion of a form board disposed on the outer surface of the foundation.
Figure 3A:
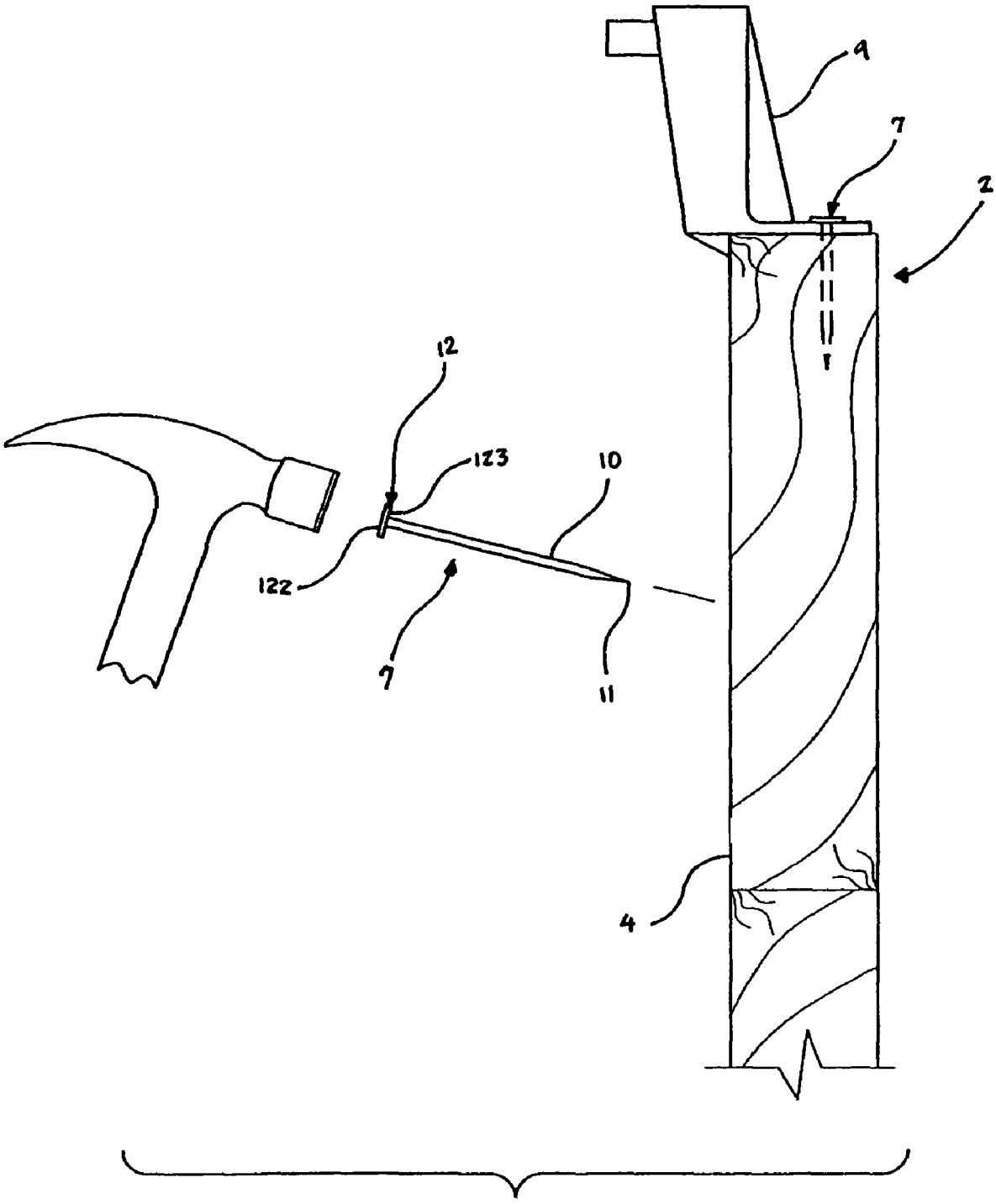
FIG. 3A is a side elevation view of a form board. A standard nail is shown ready to be partially driven into the form board.
Figure 3B:
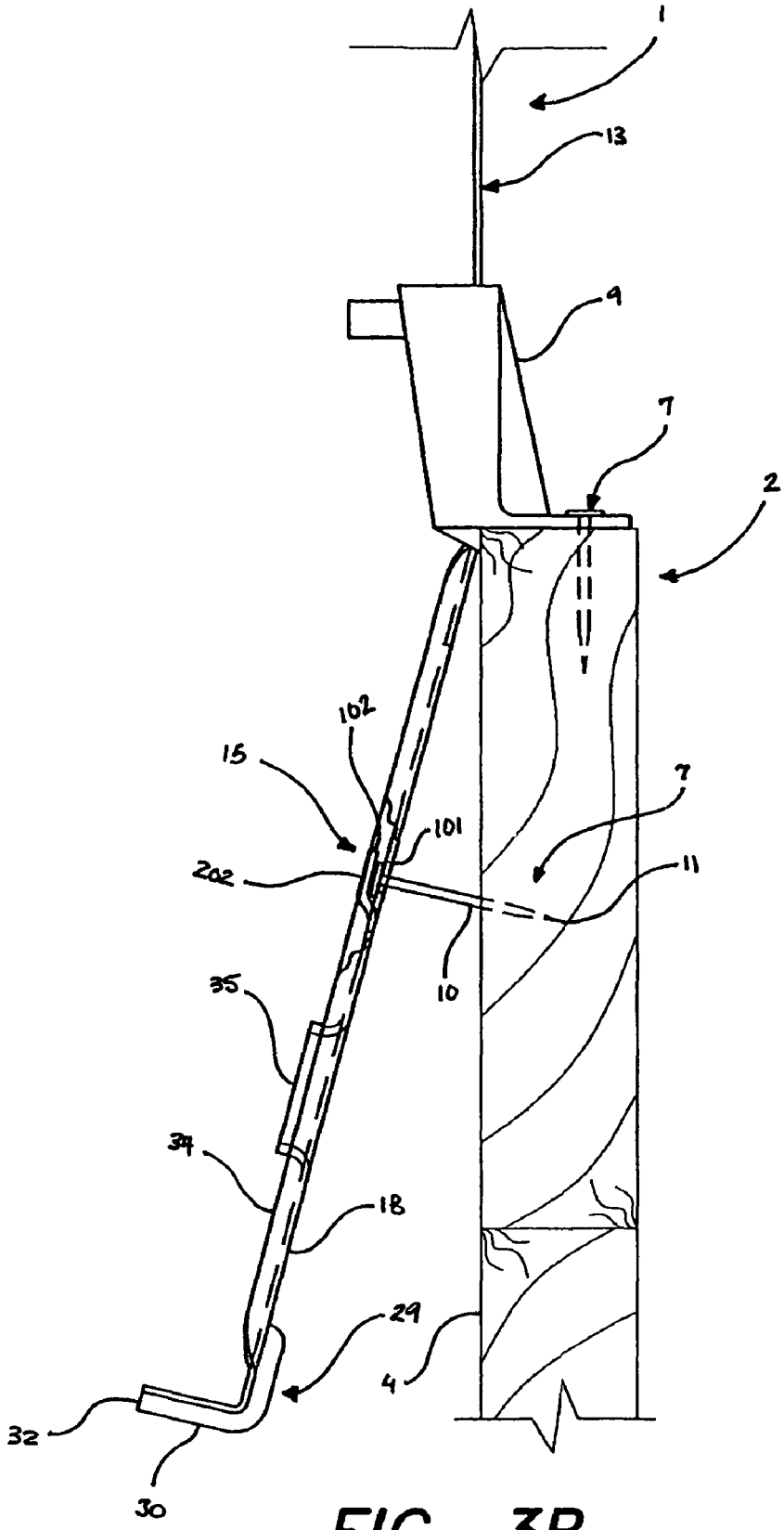
FIG. 3B is a side elevation view of a strap anchor suspended from a form board. A standard nail is shown embedded in the form board with its head in the cavity formed below the opening in the foot section, the cavity preferably formed by an embossment.

As best shown in FIGS. 1C and 2, one aspect of the present invention is a connection 100 between a connector, shown as a strap anchor 1, a second structural member, shown as a form board 2, and a first structural member, shown as a cementious member 3. The form board 2 is used to contain and forms a cementitious member 3 that is poured within the boundaries of the form boards 2. The form board 2 has an inner surface 4. As shown in FIG. 3D, the cementitious member 3 has an outer surface 5 that is at least in partially abutting relationship with the inner surface 4 of the form board 2. The cementitious member 3 also has a top surface 6.

Figure 3C:
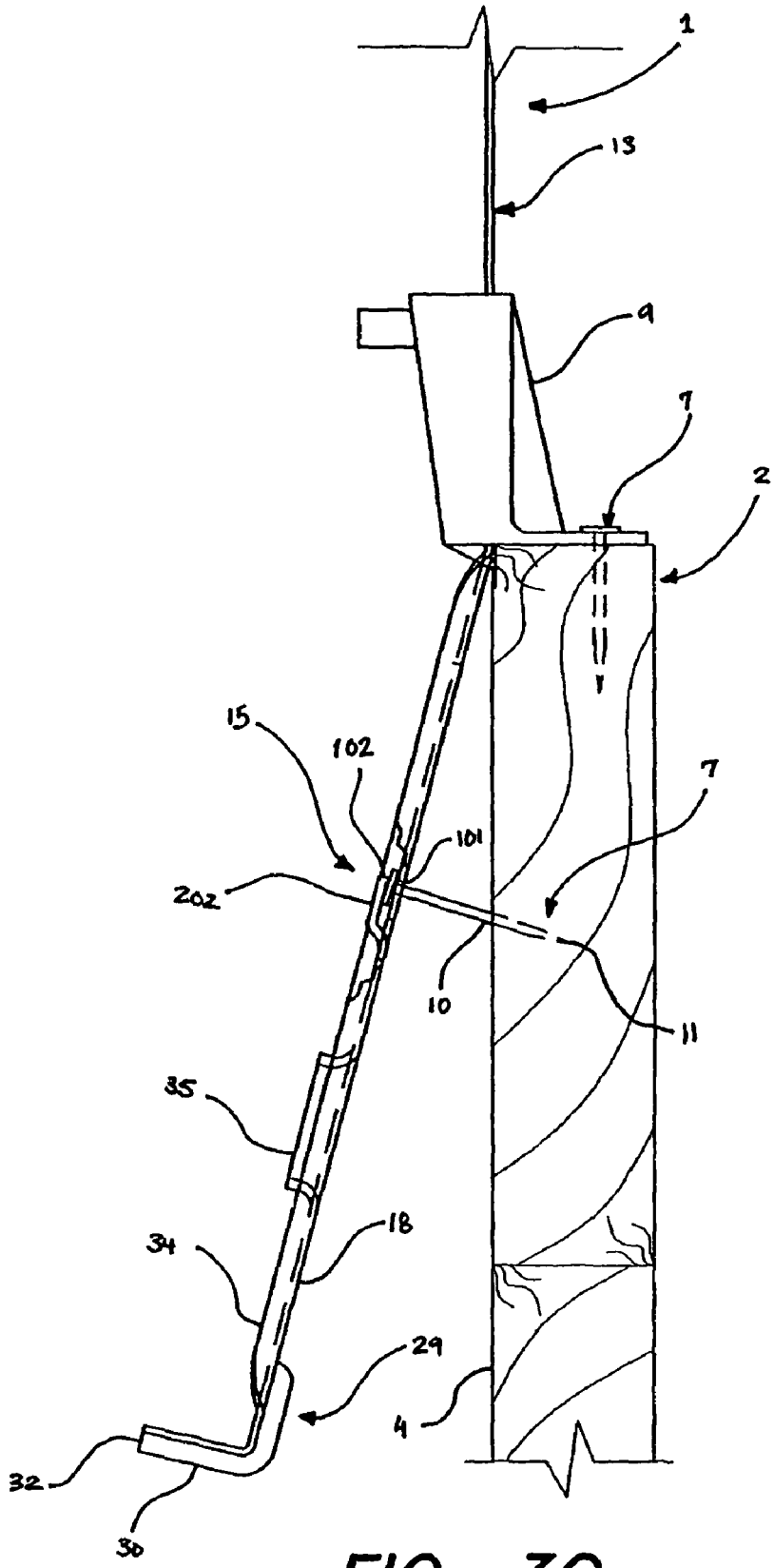
FIG. 3C is a side elevation view similar to FIG. 3B except that the head of the nail is shown trapped between the two ledges formed by opposing sides of the restraint opening.
Figure 3D:
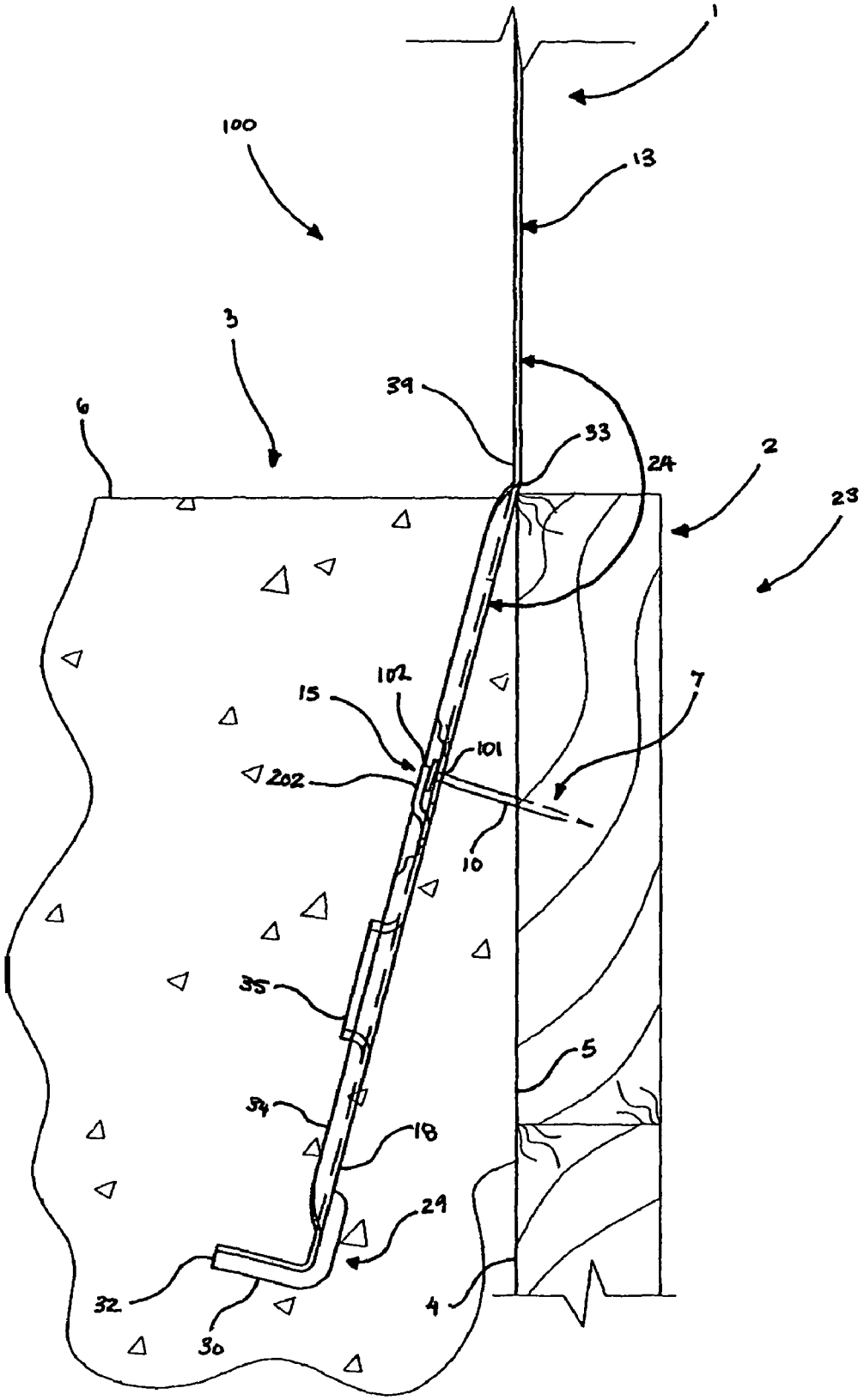
FIG. 3D is a side elevation view similar to FIG. 3C except that the concrete has been poured into the form. The foot section is shown in solid line although it would be hidden by the cement of the foundation.

Referring to FIG. 3C, the connection 100 between the form board 2 and the connector 1 is provided in part by a fastener 7. As best shown in FIG. 2, additional fasteners 7 can be used to attach the connector 1 to the form board 2. As shown in FIG. 1B a special holder 9 can also be used to attach the connector 1 to the form board 2.

According to the present invention, the fastener 7 is held by the form board 2 and protrudes from the inner surface 4 of the form board 2. Referring to FIG. 3A, the fastener 7 has an elongated relatively narrow shank 10. The shank 10 has a tip 11 that is formed to be embedded in the form board 2. The fastener 7 also has a head 12 at the opposite end of the shank 10 from the tip 11. The head 12 is held away from the inner surface 4 of the form board 2. The head 12 is wider than the relatively narrow shank 10.

As shown in FIG. 3C, in the present invention the connector 1 has an attachment section 13 that has at least some portion protruding from the cementitious member 3. The attachment section 13 is connected to the foot section 14 which is substantially planar. The foot section 14 is at least partially embedded in the cementitious member 3. As shown in FIG. 1B, the foot section 14 is formed with at least one restraint opening 15. In the preferred embodiment, the opening 15 has an aperture 204 with a first side 101 and a second side 102, wherein at least one of the first side 101 and the second side 102 is out of the plane of the substantially planar foot section 14. As shown in FIG. 1C, the fastener 7 can be positioned in the restraint opening 15 such that the first and second sides 101 and 102, which form first and second ledges 101 and 102, trap the head of the fastener 7. The second ledge 102 restrains movement of the foot section 14 along the shank 10 of the fastener 7 toward the tip 11 of the fastener 14, and the first ledge 101 retrains movement of the foot section 14 along the shank 10 of the fastener 7 away from the tip 11 of the fastener 7.

Preferably, the restraint opening 15 is created by cutting a small arc 201 through the foot section 14 and embossing the area immediately below the arc 201 so that the arc 201 follows the circumference of approximately the upper half of the embossment 202, which is substantially circular, and the head of the fastener 7 can be at least partially received in the cavity formed by the embossment 202.

As shown in FIG. 3B, in the preferred embodiment of the connection 100 of the present invention, the foot section 14 has a first side face 18 and a second side face 19. The first side face 18 is disposed toward the inner surface 4 of the form board 2.

Also in the preferred form of the connection 100 of the present invention, fastener 7 has a single head 12 that is at the end of the shank 10 away from the tip 11 of the shank 10. This is shown in FIG. 1A. The head of the fastener 12 is wider than the relatively narrow shank 10 of the fastener 7.

Such a fastener 7 with a single head 12 is preferably a nail, but it could also be a brad, tack or screw. A double-headed nail with two heads could also be used, but the second head would be superfluous. Double-headed nails are commonly used in building a wood form for containing and shaping a cementitious member 3. The second head of the double-headed nail, which lies between the first head and the tip of the shank, can prevent the nail from being driven completely into a wood member 2. This allows the nail to be more easily removed from the wood member 2, if it is desirable to disassemble the connection made with the nail. For example, after a cementitious member 3, preferably a concrete foundation 3, has been poured and set, the form is disassembled by removing the form boards 2 so that only the concrete foundation 3 remains. By this method, the form boards 2 can also be reused. If any nailed connections are made with double-headed nails and the head at the end of shank is accessible, the nail can be removed quite easily with the claw end of a typical framing hanger.

In the preferred form of the connection, as shown in FIG. 3C, the upper head of a double headed fastener would be disposed between the first side 101 and the second side 102 of the restraint opening 15. In this form of the invention, if there were a second, lower head, it would be positioned on the same side as but away from the first side face 18 of the foot section 14.

This arrangement of the first side 101 and second side 102 of the restraint opening 15 in the foot section 14 of the connector 1 and the fastener 7 prevents the connector 1 from being pushed either toward or away from the form board 2, helping to maintain the alignment of the attachment section 13 of the connector 1.

The restraint opening 15 in the foot section 14 of the connector 1 is formed so that the first side 101 and the second side 102 are spaced to allow the first head 12 of the fastener 7 to be trapped between the first and second sides 101 and 102 to prevent movement of the foot section 14 of the connector 1 up or down the shank 10 of the fastener 7 and toward or away from the inner surface 4 of the form board 2. This is because the head 12 of the fastener 7 will encounter one of the first and second sides 101 and 102 if forces act on the foot section 14 of the connector 1 to move it up or down the shank 10 of the fastener 7 or toward or away from the inner surface 4 of the form board 2. Although the preferred form of the restraint opening 15 is a small arc 201 adjacent an embossment 202, the restraint opening 15 can be any form that creates first and second sides 101 and 102 that are offset and spaced apart widely enough to permit the first head 12 of the fastener 7 to be trapped between the first and second sides 101 and 102. First side 101 restrains movement of the foot section 14 away from the tip 11 of the fastener 7 and the inner surface 4 of the form board 2, which is the second structural member 23, and the second side 102 restrains movement of the foot section 14 toward the tip 11 of the fastener 7 and the inner surface 4 of the form board 2.

As shown in FIGS. 1B-2 and 3B-3E, in the preferred embodiment, the restraint opening 15 in the foot section 14 of the connector 1 can be thought of as a shallow tunnel through the foot section 14. The tunnel is preferably formed by embossing the foot section 14 to push a portion of the foot section 14 out of the plane of the foot section 14. Preferably, the embossment 202 is made after an arc 201 has been cut or punched through the foot section 14 of the connector 1. The embossment 202 is preferably round or ovoid with a circumference that matches the arc 201 along a portion of its length. The embossment 202 is preferably just large enough to accommodate the head 12 of the fastener 7. The embossment 202 opens up the arc 201 to form a restraint opening 15 with two offset sides 101 and 102, one of the offset first and second sides 101 and 102 alongside the embossment 202 and the other of the offset first and second sides 101 and 102 of the restraint opening 15 across from the embossment 202. In the preferred form, side 101 is across from the embossment 202 and side 102 is on the embossment 202. If the foot section 14 is embossed away from the inner surface 4 of the form board 2, the first side 101 is across from the embossment 202 and the second side 102 is on the embossment. If the foot section were embossed towards the inner surface 4 of the form board 2, the first side, or first ledge would be on the embossment and the second side would be across from the embossment.

As shown in FIGS. 7A-9D, in an alternate embodiment, the restraint opening 15 has a slot 205 that branches off away from the embossment 202 so that the restraint opening 15 is roughly Y-shaped. The slot 205 is wide enough to accept the shank 10 of the fastener 7, which allows the fastener 7 to be driven through the slot 205 and then levered into place with the fastener head 12 trapped between the two offset sides 101 and 102 of the restraint opening 15. The slot 205 interrupts the side 101 or 102 that it is on.

As shown in FIGS. 4A-6D, in another alternate embodiment, the restraint opening 15 is formed by cutting a flap 203 in the foot section 14 of the connector 1. In the embodiment shown in FIGS. 4A-6D, the fastener 7 is driven into the inner surface 4 of the form board 2 after the connector 1 is attached to the form board 2. However, if the opening were wider than the head of the fastener, then the fastener could be driven into the form board 2, before the connector 1 is attached to the form board 2. When the fastener 7 is correctly positioned and the connector 1 is attached, the flap 203 is closed, trapping the first head 12 of the fastener 7 between the flap 203, the leading edge 206 of which forms one of the first and second sides 101 and 102 of the restraint opening 15 while the opposite side of the restraint opening 15 is the other of the first and second sides 101 and 102. If the flap 203 opens away from the inner surface 4 of the form board 2, the first side 101 is across from the flap 203 and the second side 102 is the leading edge 206 of the flap. If the flap 203 opened towards the inner surface 4 of the form board 2, the first side is on the leading edge of the flap and the second side is across from the flap.

In the preferred embodiment, the connector 1 has a foot section 14 with substantially planar portions 20. The foot section 14 has a top end 21 and a bottom end 22 and, as stated above, the foot section 14 is formed with at least one restraint opening 15 through it.

Figure 3E:
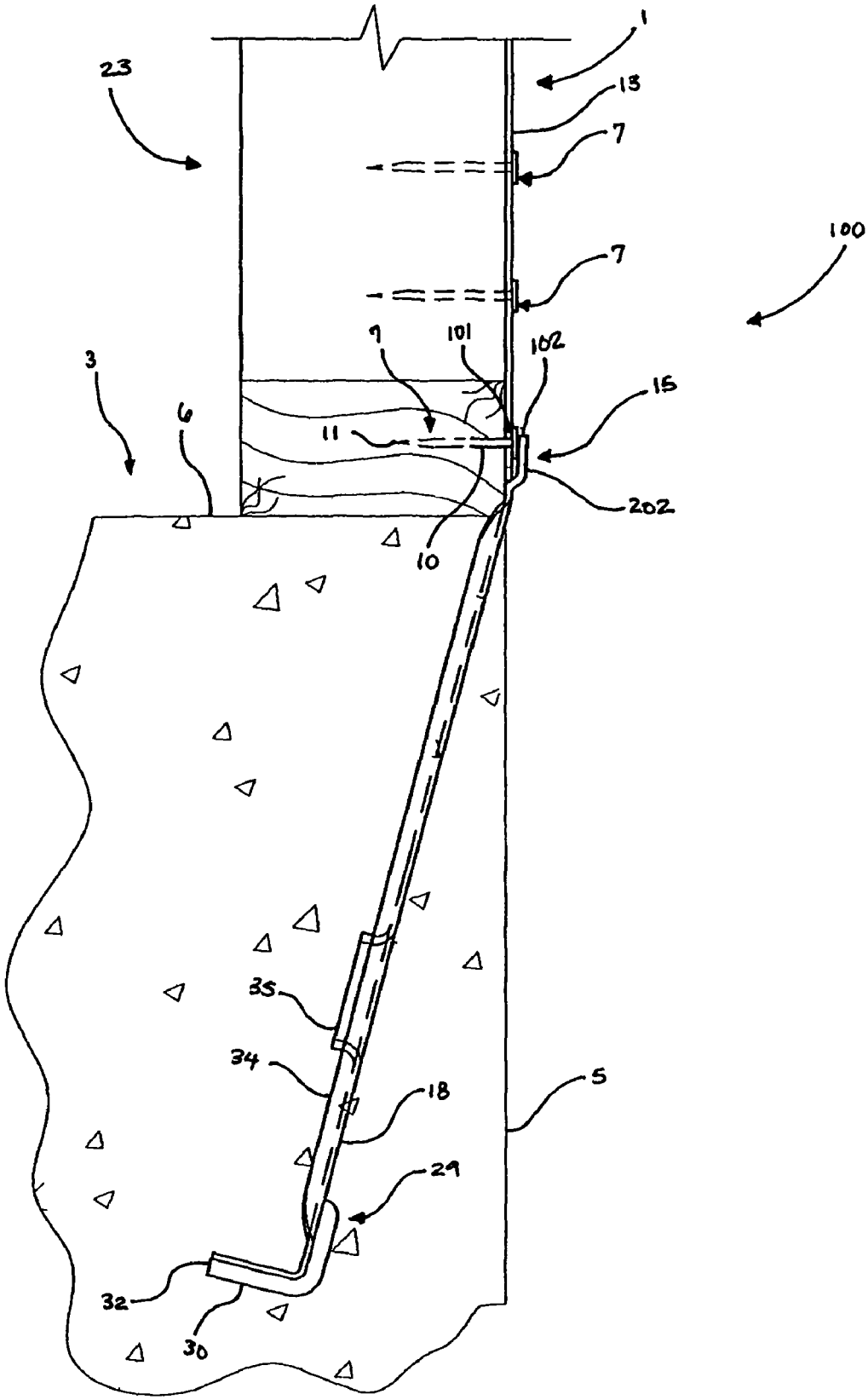
FIG. 3E is a side elevation view of a strap holdown embedded in concrete, the attachment section formed with a restraint opening and attached to the mudsill by a nail held in the restraint opening.
Figure 4A:
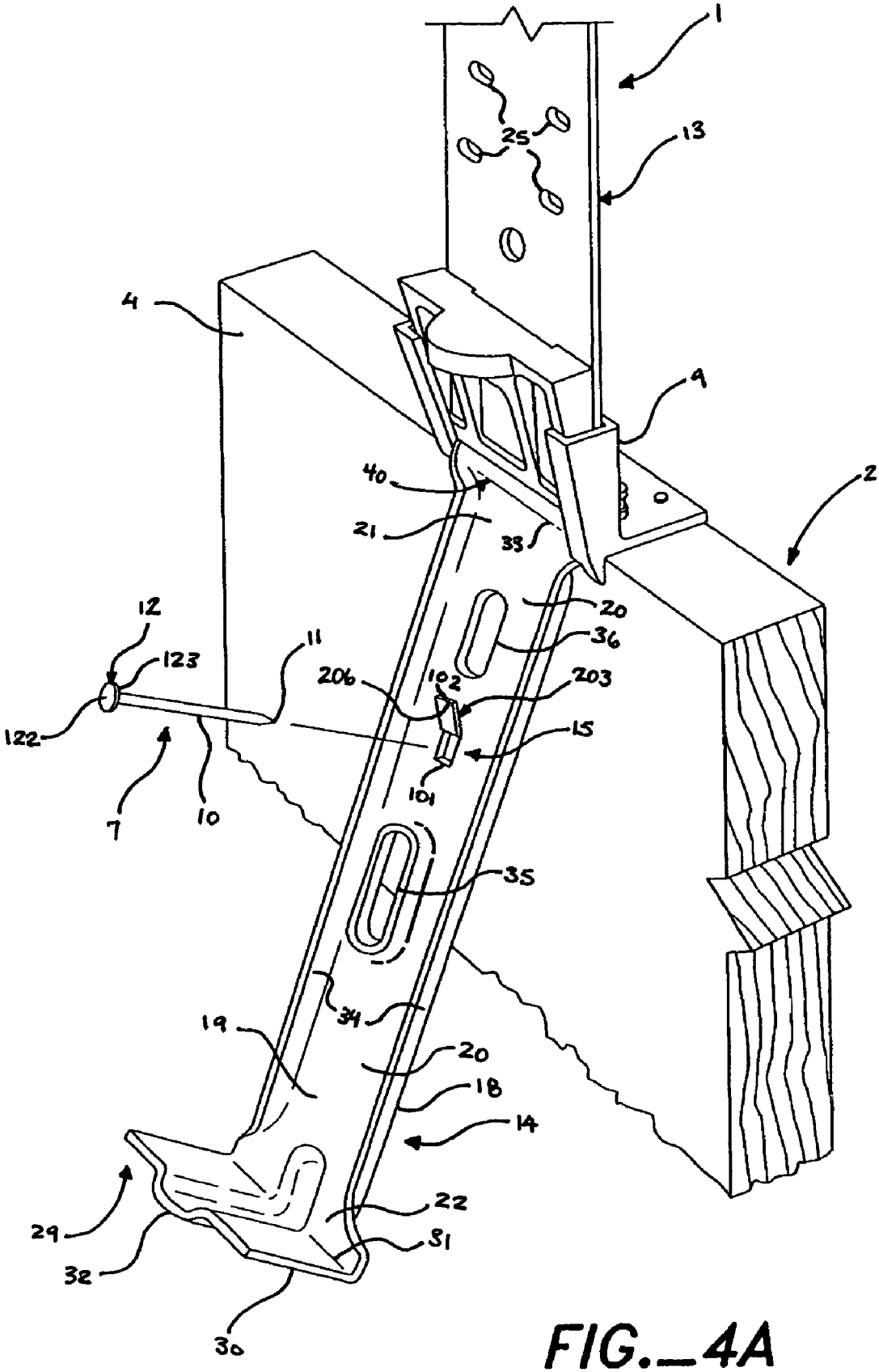
FIG. 4A is a perspective view of a strap anchor in which the restraint opening is formed with a flap and a single-headed nail is shown ready to be partially driven into the form board.
Figure 4B:
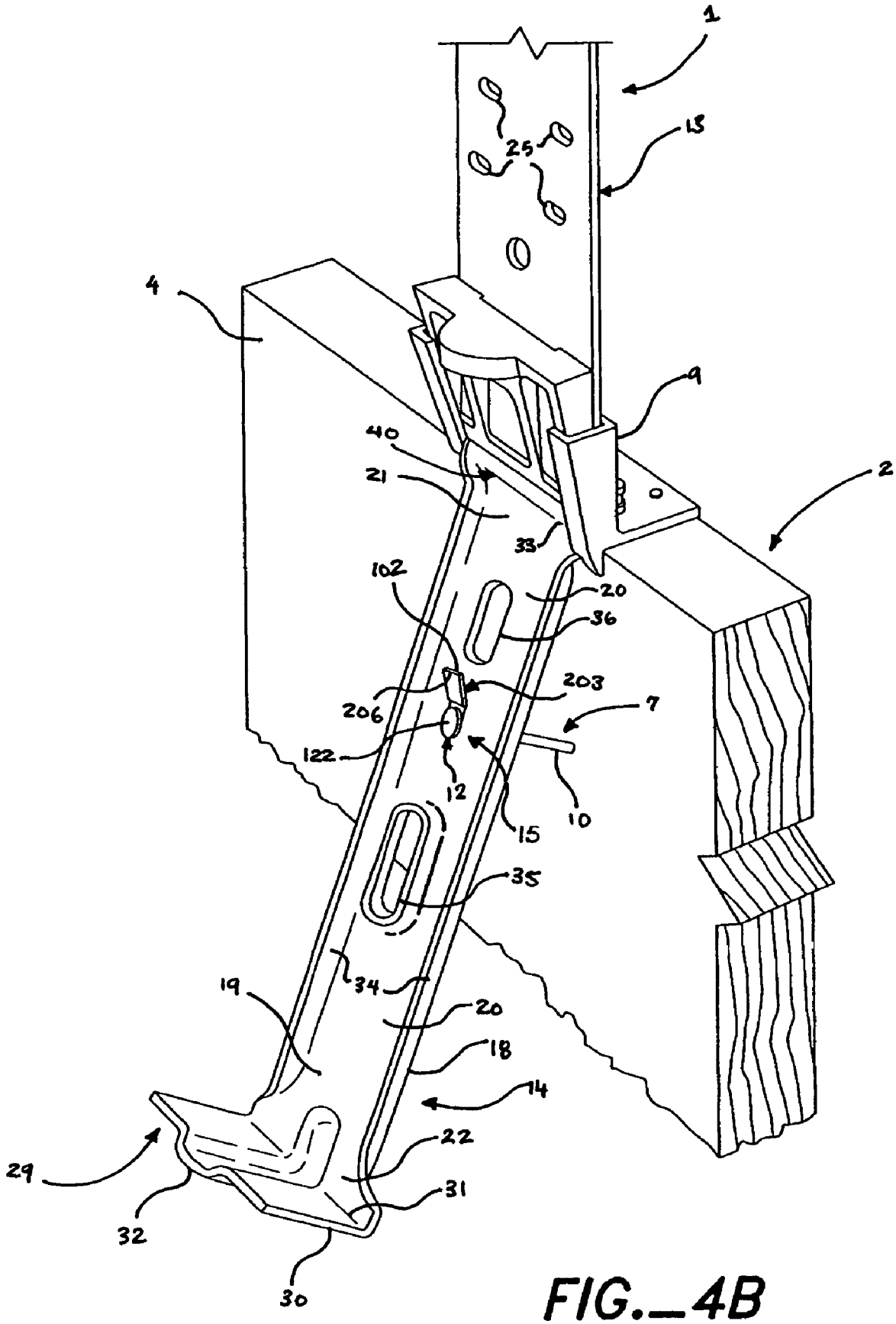
FIG. 4B is a perspective view of a strap anchor in which the restraint opening is formed with a flap and a nail has been partially hammered into the form board.
Figure 4C:
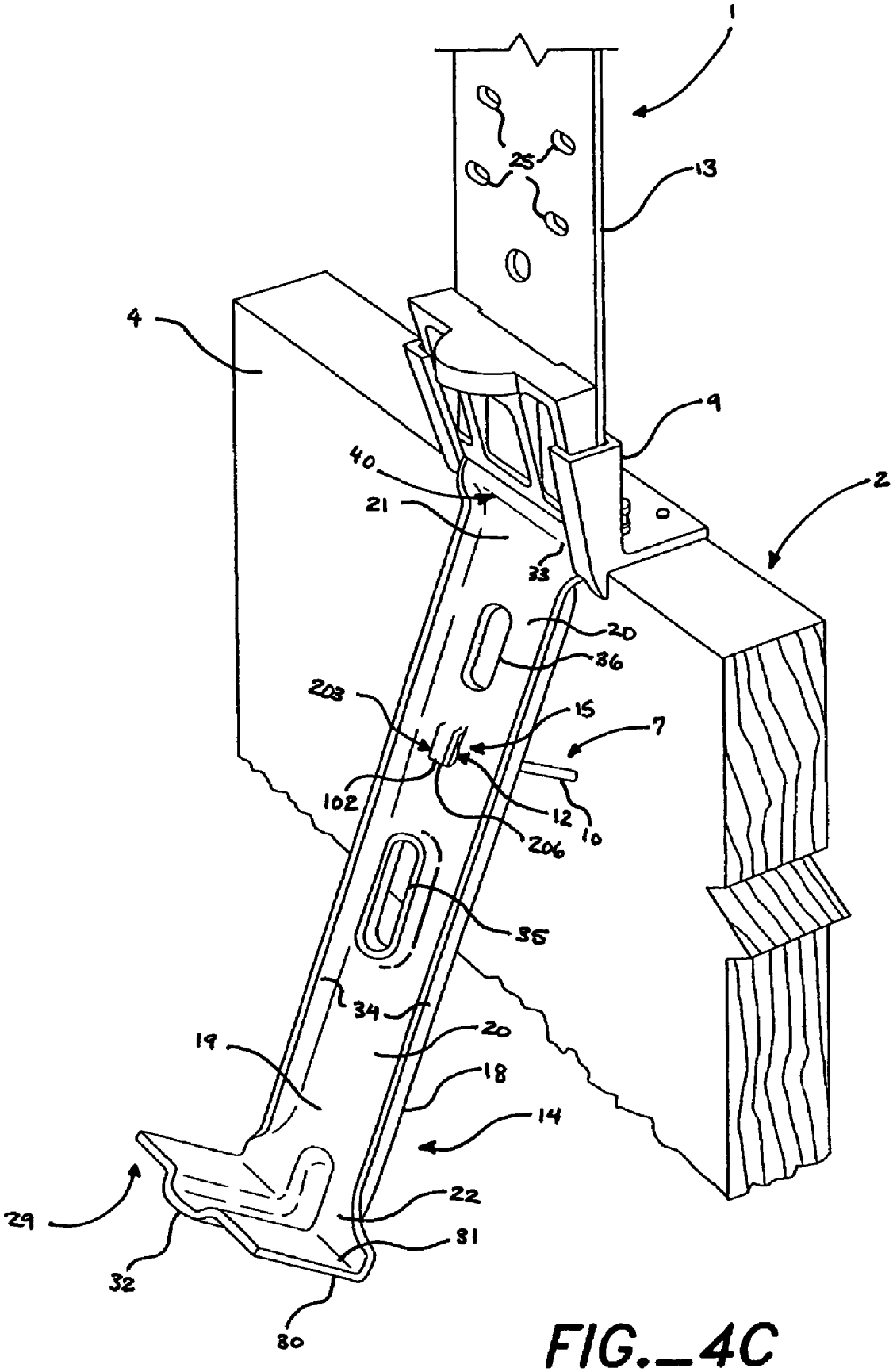
FIG. 4C is a perspective view similar to FIG. 4B except that the head of the nail is shown trapped between the two ledges formed by opposing sides of the restraint opening when the flap is closed on the nail head.
Figure 6A:
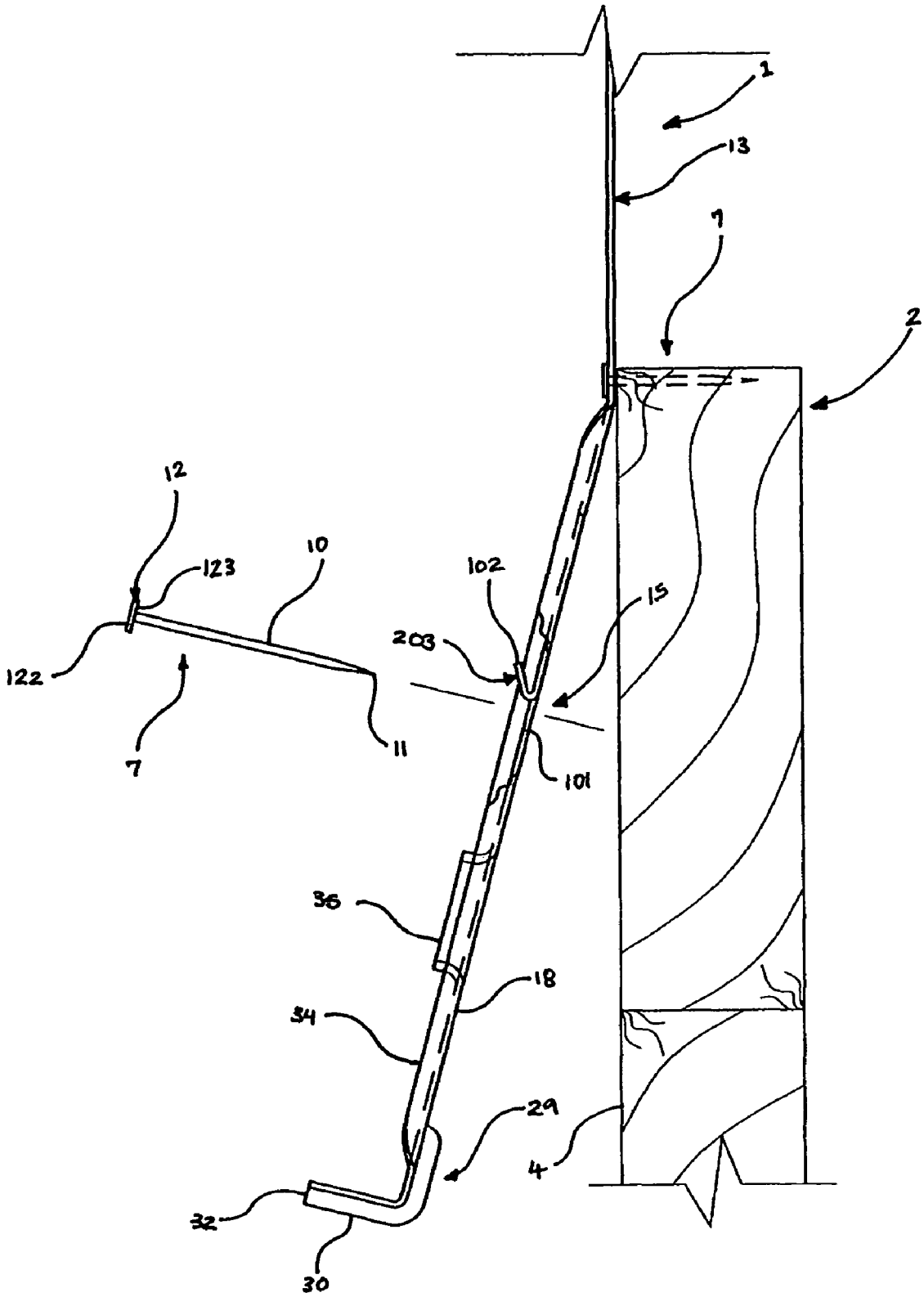
FIG. 6A is a side elevation view of a strap anchor in which the restraint opening is formed with a flap and a single-headed nail is shown ready to be partially driven into the form board.
Figure 6B:
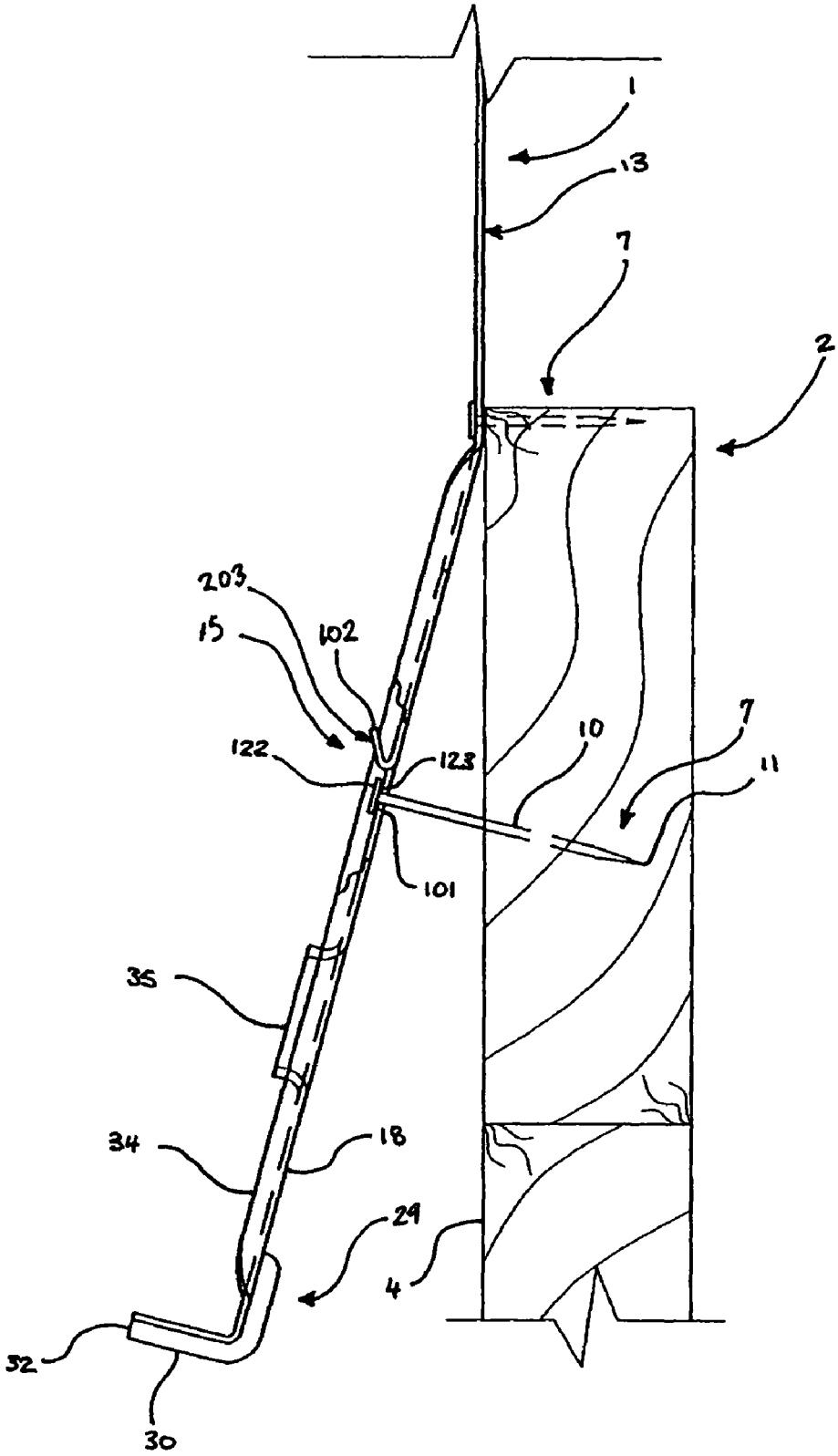
FIG. 6B is a side elevation view of a strap anchor in which the restraint opening is formed with a flap and a nail is partially embedded in the form board.
Figure 6C:
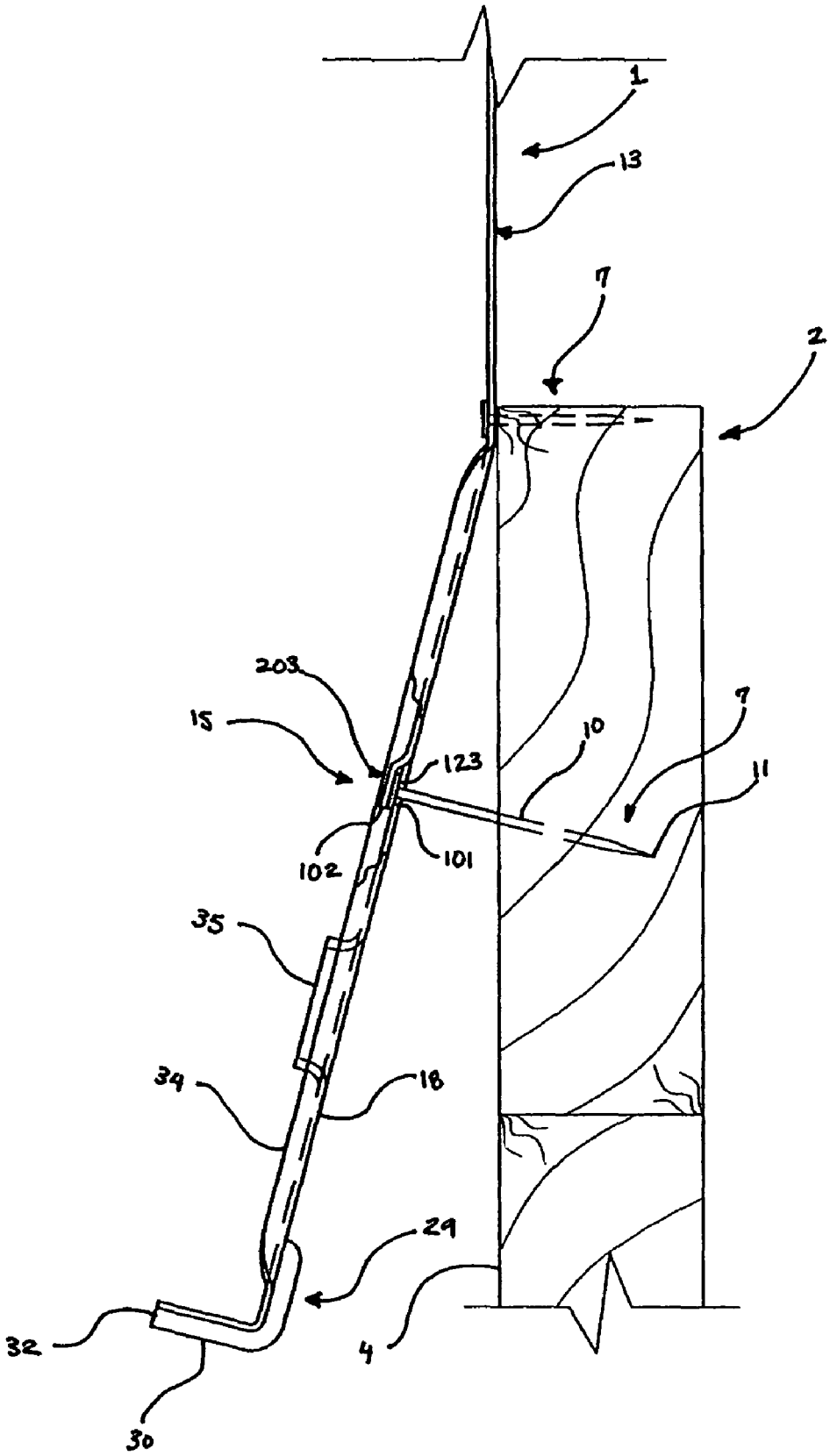
FIG. 6C is a side elevation view similar to FIG. 6B except that the head of the nail is shown trapped between the two ledges formed by opposing sides of the restraint opening when the flap is closed on the nail head.
Figure 6D:
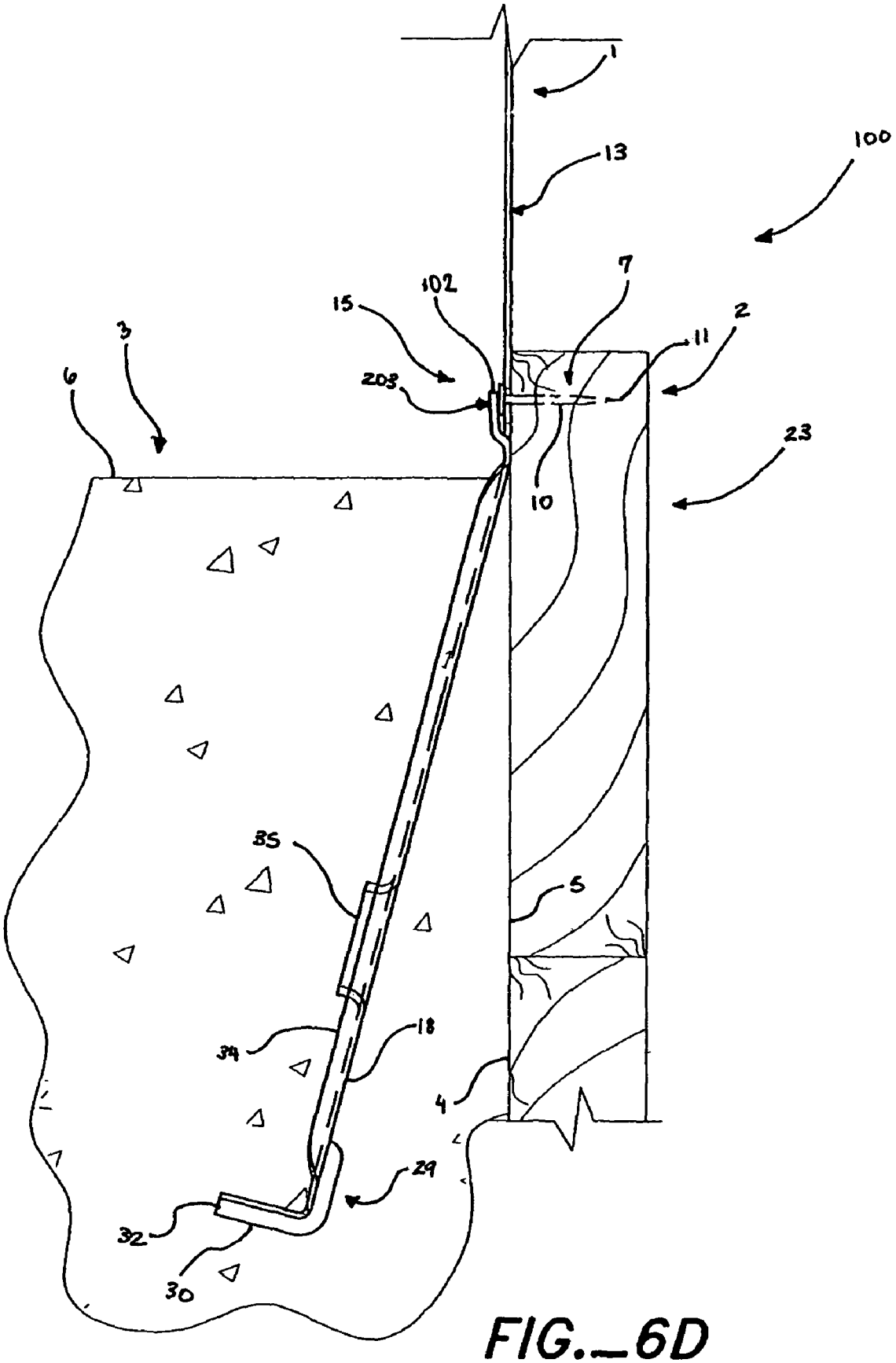
FIG. 6D is side elevation view of a strap anchor formed with a restraint opening in the attachment section, attached to the formboard with a nail.
Figure 7A:
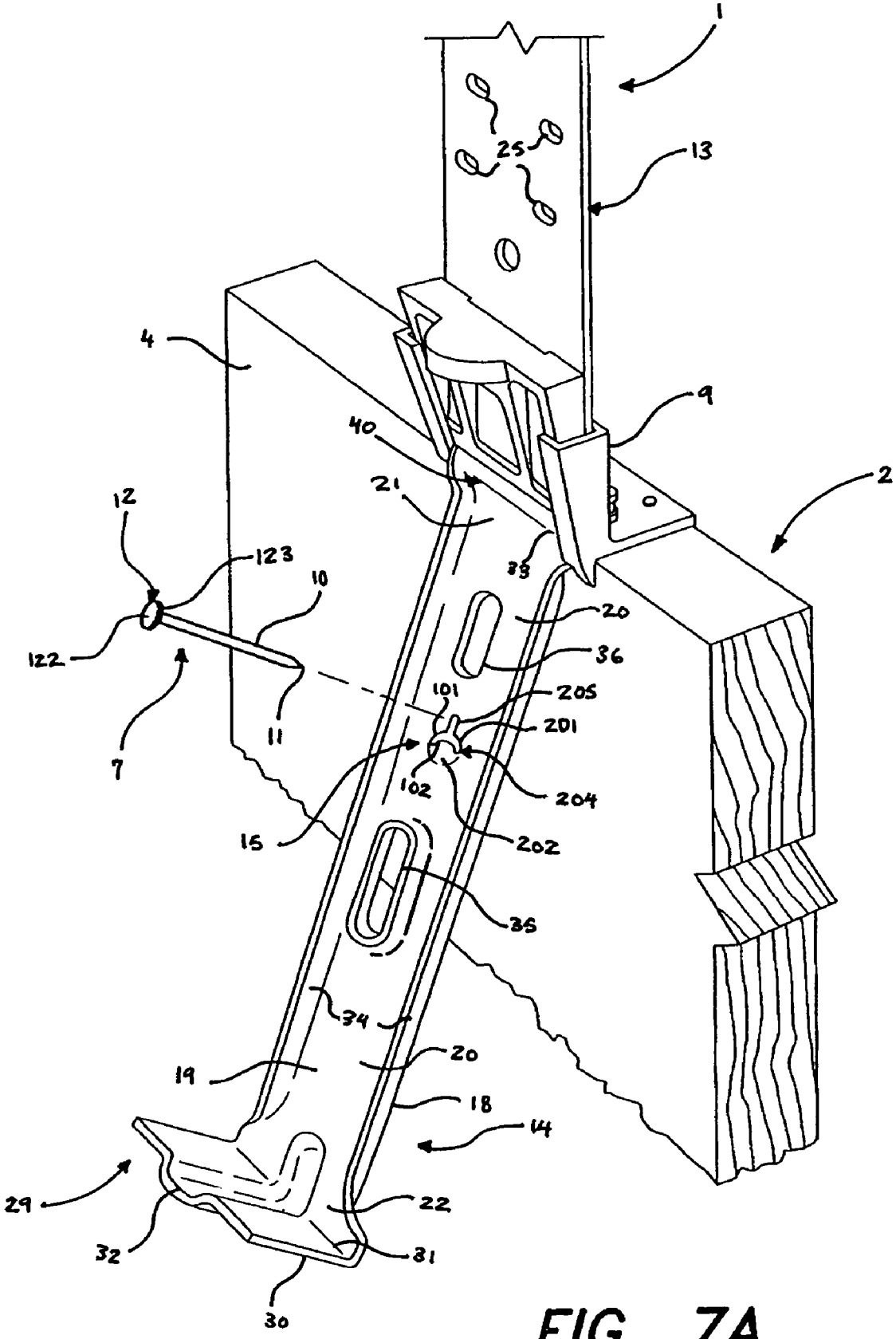
FIG. 7A is a perspective view of a strap anchor in which the restraint opening is formed with a Y-shaped aperture that allows the nail to be driven through the aperture and a single-headed nail is shown ready to be partially driven into the form board.
Figure 7B:
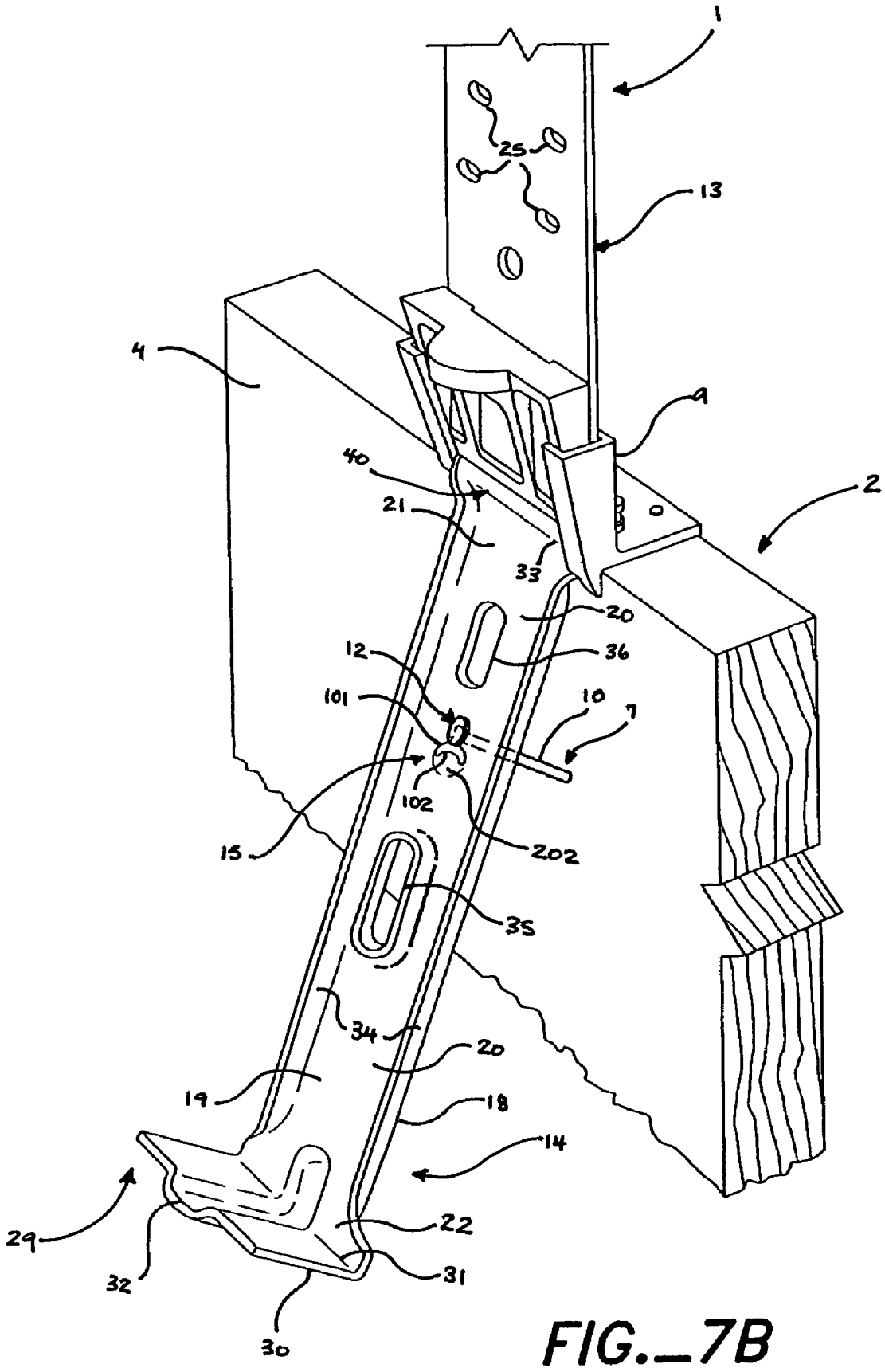
FIG. 7B is a perspective view of a strap anchor in which the restraint opening is formed with an Y-shaped aperture that allows the nail to be driven through the aperture and a nail has been partially hammered into the form board
Figure 7C:
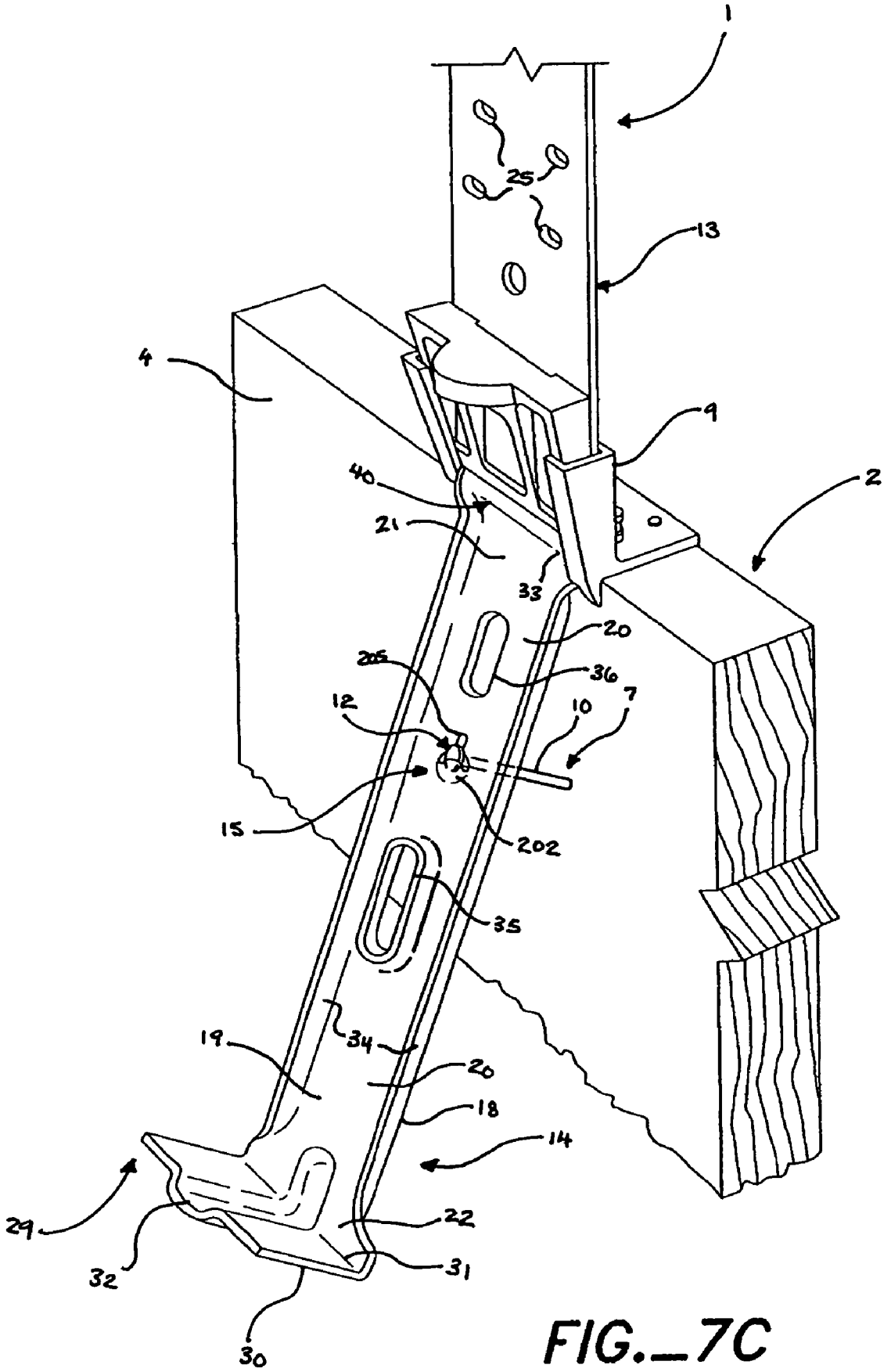
FIG. 7C is a perspective view similar to FIG. 7B except that the head of the nail is shown trapped between the two ledges formed by opposing sides of the opening and the concrete has been poured into the form. The foot section is shown in solid line although it would be hidden by the cement of the foundation.
Figure 9A:
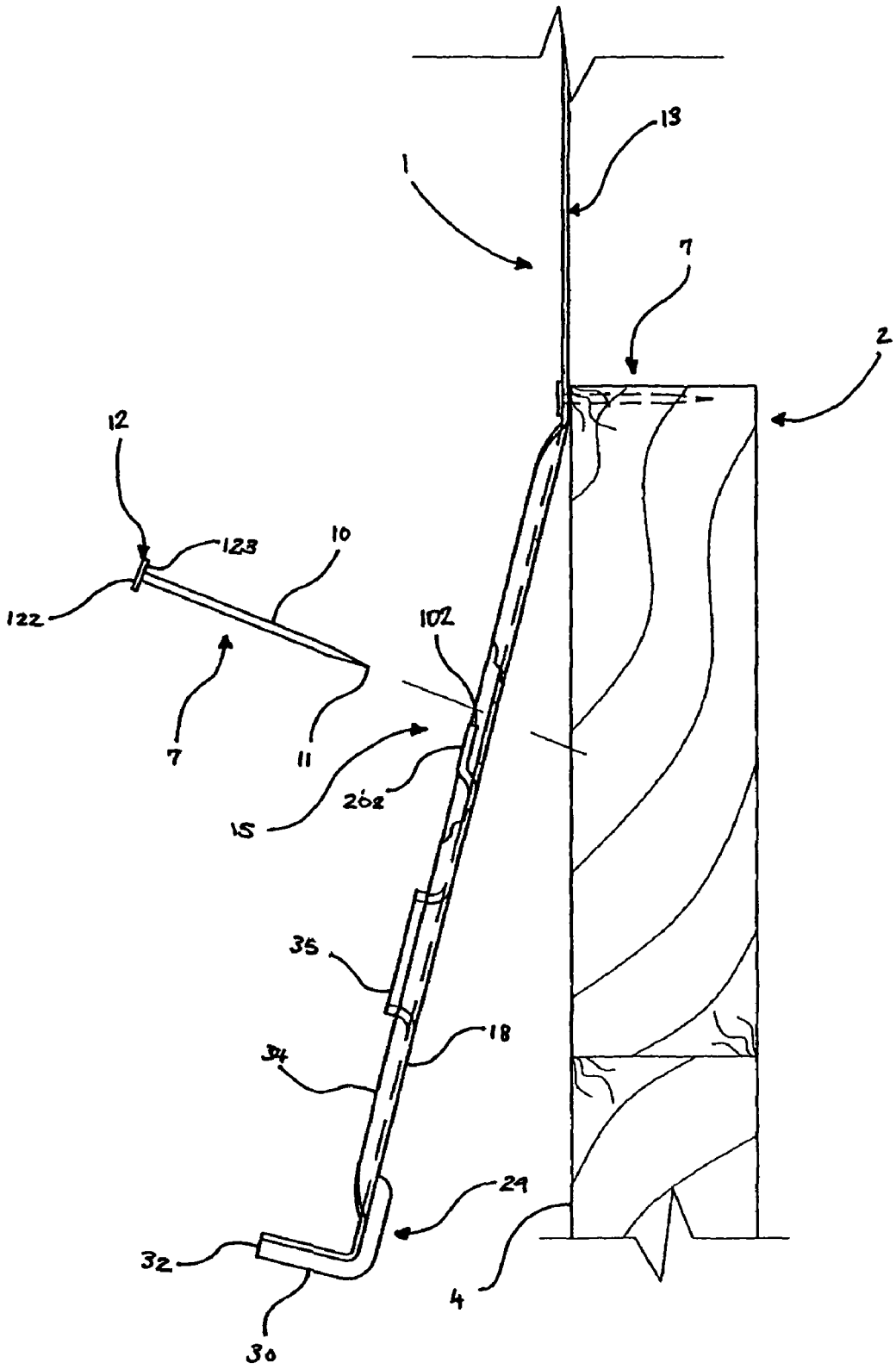
FIG. 9A is a side elevation view of a strap anchor in which the restraint opening is formed with an Y-shaped aperture that allows the nail to be driven through the aperture and a single-headed nail is shown ready to be partially driven into the form board.
Figure 9B:
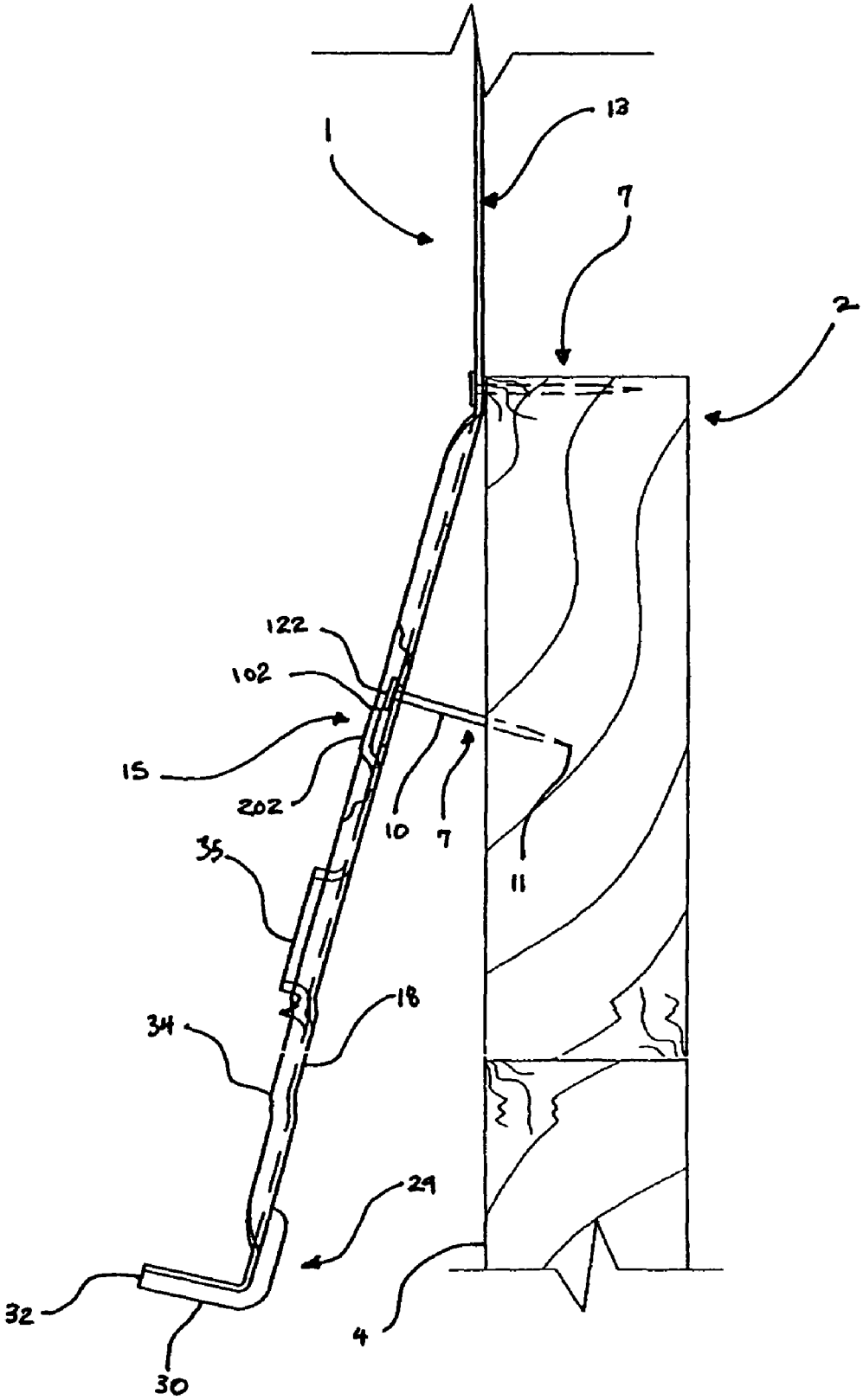
FIG. 9B is a side elevation view of a strap in which the restraint opening is formed with an Y-shaped aperture that allows the nail to be driven through the aperture and a nail is partially embedded in the form board.
Figure 9C:
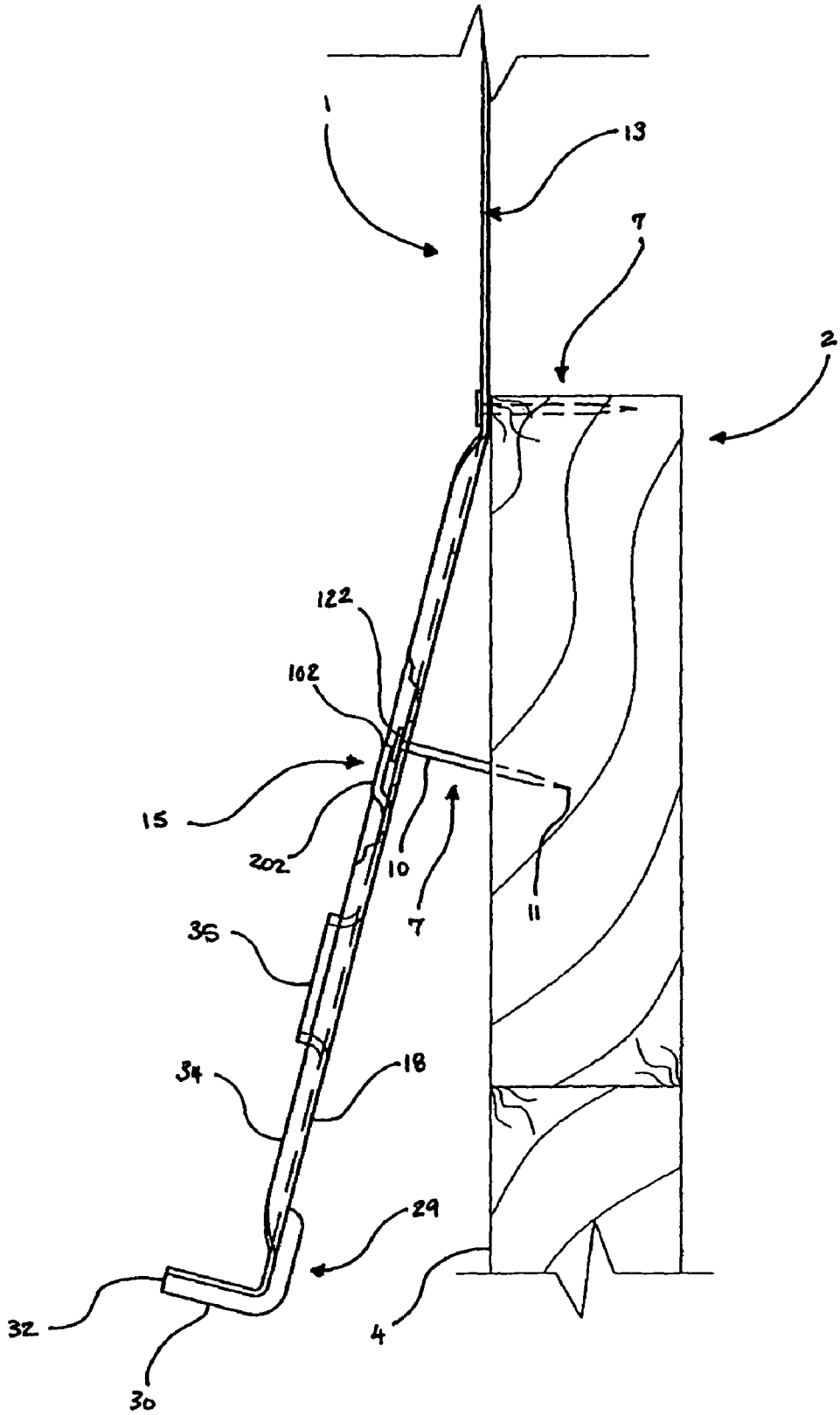
FIG. 9C is a side elevation view similar to FIG. 9B except that the head of the nail is shown trapped between the two ledges formed by opposing sides of the restraint opening.
Figure 9D:
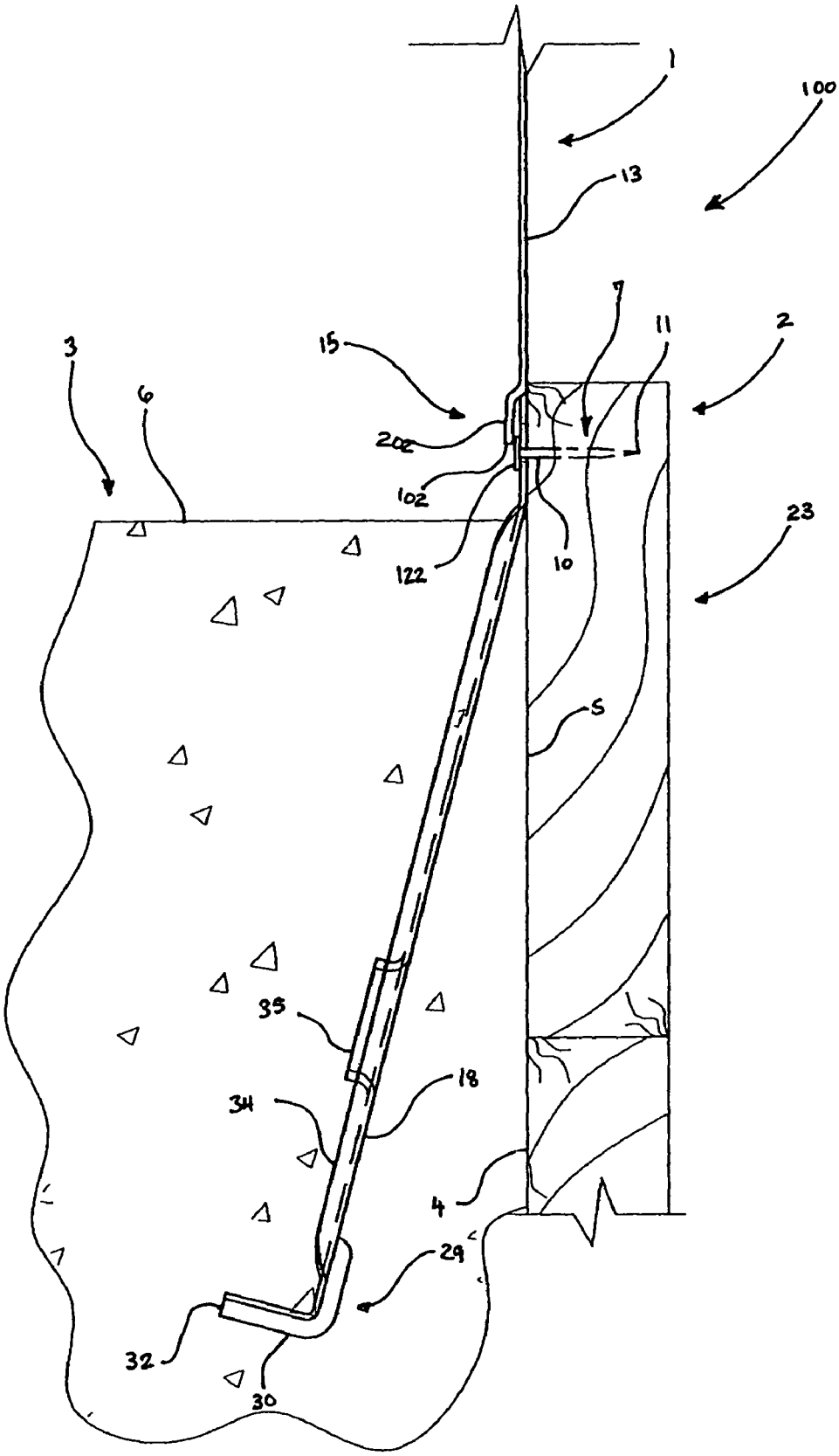
FIG. 9D is side elevation view of a strap anchor formed with a restraint opening in the attachment section, attached to the formboard with a nail.

As shown in FIGS. 3E, 6D and 9D, in other alternate embodiments, the connector 1 can be any connector 1 that connects a first structural member, such as a cementitious member 3, a wood structural member or the like, and a second structural member 23, such as a form board 2, wood structural member or the like, where the connector 1 is attached to one of the first and second structural members 3 and 23 by the interlocking of at least one restraint opening 15, having a first ledge 101 and a second ledge 102, with at least one fastener 7 with a head 12, a shank 10. If the fastener 7, has a tip 11, the tip 11 of the fastener 7 is driven into one of the first and second structural members 3 and 23, and a selected length of the shank 10 is embedded in that first or second structural member 3 or 23. The connector 1 can be hung from the shank 10 of the fastener and restrained on the shank 10 of the fastener 7 by the head 12 of the fastener 7. The restraint opening 15 interlocks with the head 12 of the fastener and provides either a permanent or temporary attachment. The connector 1 can then be attached to the other of the first and second structural members 3 and 23, and the attachment by means of the restraint opening 15 and the fastener 7 can be reinforced with additional fasteners 7.

As shown in FIG. 1B, the preferred connector 1 is also formed with an elongated, substantially planar attachment section 13 integrally connected to the top end 21 of the foot section 14. As shown in FIG. 3D, the attachment section 13 is disposed at a selected angle 24 to the foot section 14 to direct the foot section 14 away from the inner surface 4 of the form board 2. This selected angle 24 is dependent on such factors as the length of the foot section 14 and the dimensions of the cementitious member 3. As shown in FIG. 3D, the selected angle 24 is preferably more than 180 degrees between the first side face 18 of the foot section 14 and the attachment section 13. There is a main longitudinal bend 33 where the attachment section 13 and the foot section 14 meet.

As also shown in FIG. 1B, in the preferred embodiment the attachment section 13 is formed with a plurality of restricted openings 25. These openings 25 are large enough to receive the shanks 10 of additional fasteners 7, but too small to receive the heads 12 of additional fasteners 7 when the additional fasteners 7 pass through the restricted openings 25 and into the second structural member 23 adjacent the attachment section 13. The additional fasteners 7 are preferably 16*d* nails.

As shown in FIG. 1B, in the preferred embodiment the connector 1 is formed with a hook section 29 integrally connected to the bottom end 22 of the foot section 14. The hook section 29 is formed to provide mechanical interlock with the cementitious member 3.

As shown in FIG. 2, in the preferred embodiment of a connector 1 formed in accordance with the present invention, a lower portion 30 of the hook section 29 is wider than the foot section 14. The hook section 29 is formed with a generally orthogonal bend 31 for creating improved mechanical interlock with the concrete member 3. Also, in the preferred embodiment the hook section 29 is formed with a longitudinal embossment 32 that stiffens both the generally orthogonal bend 31 and the hook section 29.

For the connections shown in FIGS. 1A-C, 2, 3A-D, 4A-C, 5, 6A-C, 7A-C, 8, 9A-C, the location of the restraint opening 15 in the foot section 14 that receives the head 12 of a fastener 7 is determined primarily by the length of the fastener 7 and the selected angle 24 of the main longitudinal bend 33.

The preferred embodiment of the foot section 14 may also be formed with such features as curled side edges 34, a drawn opening 35 and a second opening 36 to improve the interconnection of the foot section 14 and the cementitious member 3.

The preferred embodiment of the strap anchor 1 is formed from galvanized sheet steel. This permits the connector 1 to be made on standard automated machinery which is common in the sheet metal connector industry. Furthermore, the preferred embodiment requires no secondary operations after it is formed, such as welding or painting. This further reduces manufacturing costs.

The preferred embodiment of the strap anchor 1 is also formed in accordance with the preferred embodiment of U.S. Pat. No. 5,813,182, granted Sep. 29, 1998, the content of which is herein incorporated by reference.

For example, the following is a description of a strap anchor 1 formed in accordance with the preferred form of the present invention that would be used to make a connection between a stem wall 3 and a wood wall stud in a typical light wood-frame building. The strap anchor 1 is formed from 12-gauge G60 galvanized sheet steel, and is approximately 3 inches wide. The foot section 14 and the hook section 29 together reach an embedment depth of approximately 8 inches.

The longitudinal embossment 32 in the hook section 29 is approximately 1 inch wide by 2¾ inches long. The displaced portion of the hook section 29 is 1½ inches long by 3 inches wide.

The foot section 14 is formed with curled side edges 34, a drawn opening 30, and the restraint opening 15 for receiving a fastener 7. The drawn opening 35 is located approximately 4½ inches from the generally orthogonal bend 31 in the hook section 29. The drawn opening 35 is formed as an obround slot 35 that is approximately 1⅞ inches long and ⅞ inches wide. The curled side edges 34 reduce the width of the foot section 14, making it approximately 2 7/16 inches wide. The embossment 202 of the restraint opening 15 for receiving the fastener 7 is located approximately 4⅝ inches from the main longitudinal bend 33 in the connector 1. The embossment 202 of the restraint opening 15 is circular and has a diameter greater than that of the head 12 of the preferred fastener 7, a 16*d* nail. The arc 201 of the restraint opening 15 is approximately half the circumference of the head 12 of the preferred fastener 7 and is contiguous with the upper approximately half of the embossment 202 of the restraint opening 15. The arc 201 is at least slightly wider than the width of the head 12 of the preferred fastener 7.

Figure 5:
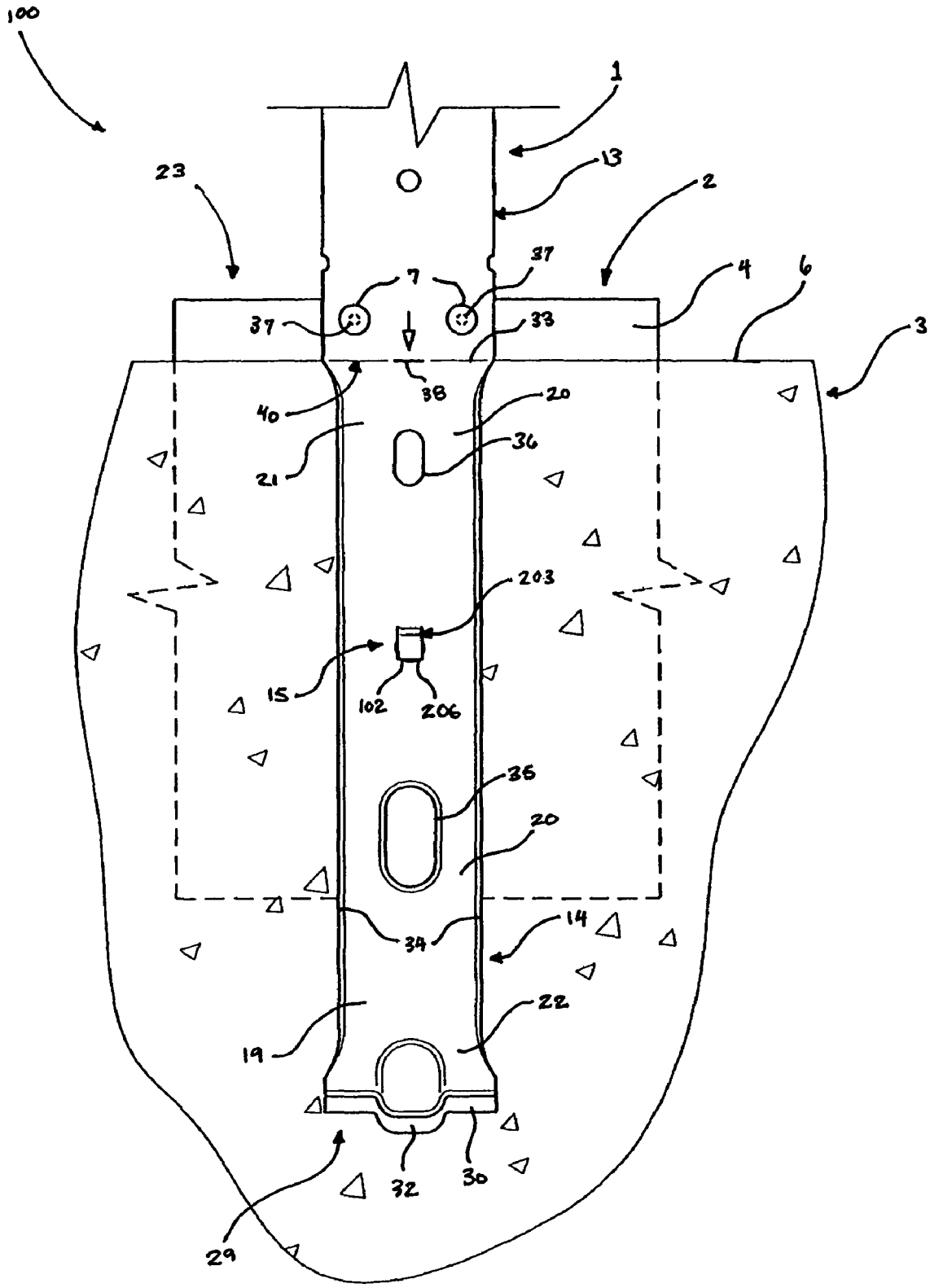
FIG. 5 is a front elevation view of a connector embedded in a foundation. The foot portion of the connector is shown in solid lines although it would be hidden by the foundation. Phantom lines show a portion of a form board disposed on the outer surface of the foundation.
Figure 8:
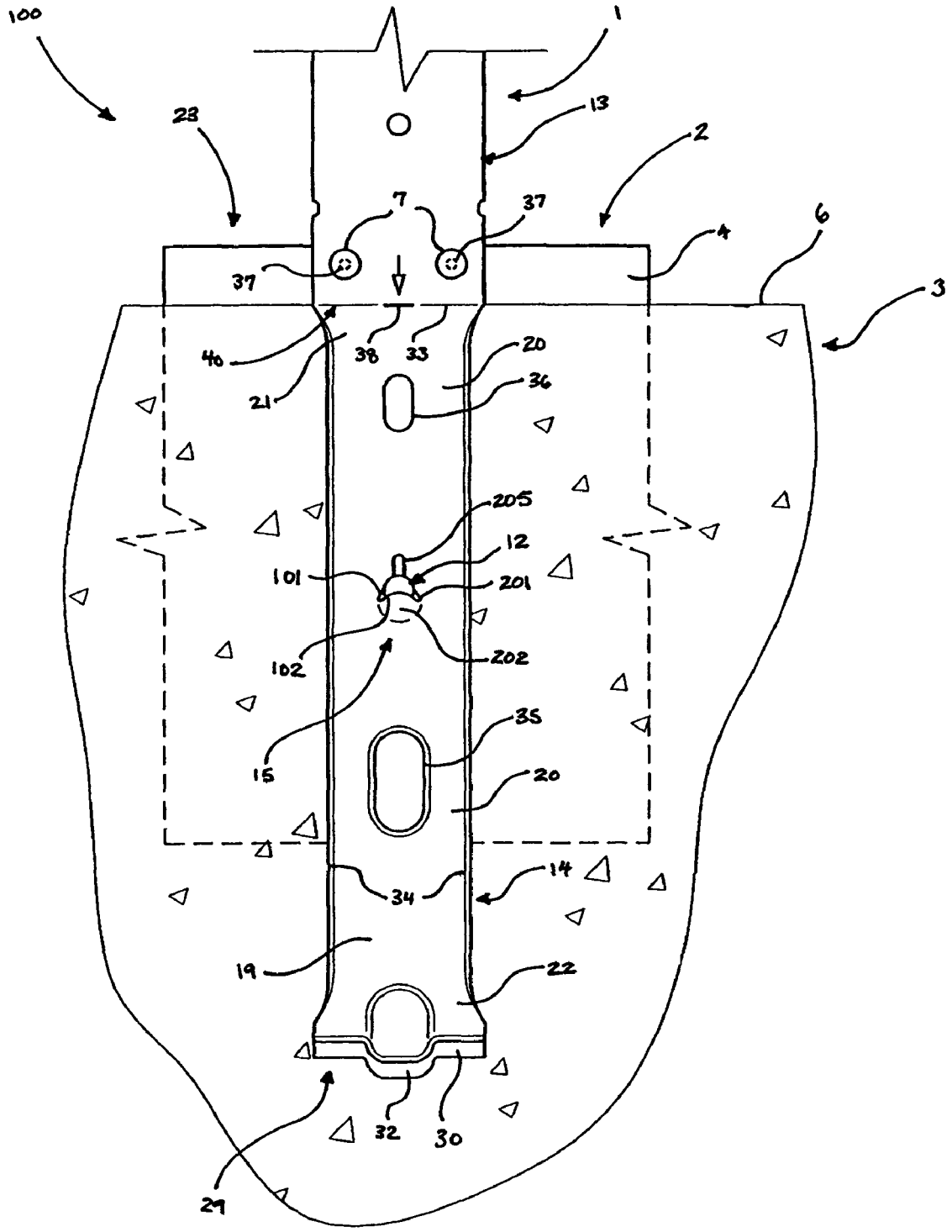
FIG. 8 is a front elevation view of a connector embedded in a foundation. The foot portion of the connector is shown in solid lines although it would be hidden by the foundation. Phantom lines show a portion of a form board disposed on the outer surface of the foundation.

The attachment section 13 is approximately 21⅝ inches long and 3 inches wide. The attachment section 13 is formed with twenty-four obround openings 25 for receiving 16*d* sinker nails 7 to permanently attach the strap anchor 1 to a wall stud. As shown in FIGS. 2, 5 and 8, two openings 37 can be added to the attachment section 13 near the top end 21 of the foot section 14 for temporarily attaching the strap anchor 1 to a form board 2. The strap anchor 1 is formed with embedment indicia 38 to aid the installer in attaching the connector 1 to the form board 2 at the proper height, so that the fasteners 7 enter the wall stud at the best height. The foot section 14 is displaced from the plane of the attachment section 13 at a selected angle 20 of 206 degrees.

The use and formation of a connection according to the present invention is illustrated in FIGS. 1A-1C, 4A-4C and 7A-7C.

First, a form is created that is to be filled with an uncured cementitious member 3. The form consists of form boards 2 and at least some of the form boards 2 have inner surfaces 4 that will define the outer surfaces 5 of the foundation 3 when the cementitious member 3 has cured.

Second, a fastener 7 is selected. According to the present invention, the fastener 7 has a narrow shank 10 with a head 12 attached thereto at one end, the head 12 of the fastener 7 being wider than the shank 10, and the shank 10 having a tip 11 at an opposite end from the head 12 of the fastener 7

Third, a connector 1 is selected. The connector 1 has an attachment section 13 and a foot section 14. The attachment section 13 has a bottom end 39. The foot section 13 is formed with at least one restraint opening 15 therethrough. In the preferred embodiment, the restraint opening 15 has a first side 101 and a second side 102. The two sides 101 and 102 are offset so that at least one of the two sides 101 and 102 is out of the plane of the foot section 14, spaced to admit at least part of the head 12 of the fastener 7 so that one of the first and second side 101 and 102 is above and the other is below the head 12 of the fastener 7. Preferably, the first and second sides 101 and 102 are an arc 201 that is opened up on the edge of an embossment 202 when it is formed that is large enough to accommodate the head 12 of the fastener 7.

The foot section 14 also has a top end 21 and a bottom end 22, and the attachment section 13 and the foot section 14 are connected together at a transition area 40. The transition area 40 comprises the bottom end 39 of the attachment section 13 and the top end 21 of the foot section 14.

The tip 11 of the fastener 7 is driven into the inner surface 4 of one of the form boards 2 at a selected location and to a selected depth so that the head 12 of the fastener 7 is in essentially the same position that the restraint opening 15 in the foot section 14 of the connector 1 will occupy when properly aligned.

The connector 1 is then moved into place so that the head 12 of the fastener 7 interfaces with the restraint opening 15 in the foot section 14.

The connector 1 is then suspended in the form such that the transition area 40 Is substantially adjacent to the inner surface 4 of one of the form boards 2. Furthermore, the connector 1 is suspended in such a manner that at least a portion of the attachment section 13 of the connector 1 protrudes out of the form. This is preferably accomplished with the special holder 9.

Suspended in this manner, at least a portion of the attachment section 13 of the connector 1 will protrude out of the cementitious member 3 after it has cured and, preferably, substantially all of the attachment section 13 will protrude out of the cementitious member 3 after it has cured. The bottom end 22 of the foot section 14 of the connector 1 is disposed within the form and is removed from the inner surface 4 of the form board 2 to which the transition section 40 is substantially adjacent.

Finally, the form is filled with the wet cementitious member 3 and the cementitious member 3 is allowed to cure.

According to the preferred method of making the connection, the foot section 14 has a first side face 18 and a second side face 19. The first side face 18 is disposed towards the inner surface 4 of the form board 2 when the connector 1 is suspended in the form. The preferred fastener 7 is a single-headed nail 7.

In the preferred method of making the connection, the fastener 7 is driven into the form board 2 at an angle so that the head 12 of the fastener 7 lies parallel to the general orientation of the preferred foot section 14 of the connector 1. However, the inventor has found that the angle of the fastener 7 is not critical to the performance of the connection.

In the preferred method of making the connection, after the tip 11 of the fastener 7 is driven into the inner surface 4 of the form board 2, the head 12 is disposed between the first and second sides 101 and 102 of the restraint opening 15 so that the head 12 overlaps both the first side face 18 and the second side face 19 of the foot section 14.

In the preferred method of making the connection, the opening 15 is formed as an arcuate aperture 204 adjacent a round embossment 202. The embossment 202 deforms the foot section 14 away from the inner surface 4 of the form board 2. Preferably, the aperture 204 is oriented toward the attachment section 13 and the embossment 202 is oriented toward the hook section 29. The fastener 7 is driven into the form board 2 and the foot section 14 is then attached to the fastener 7 by interlocking the head 12 of the fastener 7 with the first and second sides 101 and 102 of the restraint opening 15.

We claim:

1. A connection comprising:

a. a first structural member, b. a second structural member, said second structural member comprising a first surface;

c. a fastener held by said second structural member and protruding from said first surface of said second structural member, said fastener comprising a relatively narrow shank, said fastener also comprising a head attached to said shank, said head being held away from said first surface of said second structural member, said head being wider than said relatively narrow shank, said head having a top surface and a bottom surface;

d. a connector attached to said first structural member, and also attached to said second structural member by said fastener, wherein:

i. said connector is formed with at least one restraint opening therethrough, said restraint opening being formed to have a first ledge and a second ledge that are spaced apart;

ii. said head of said fastener is inserted between said first ledge and said second ledge such that said first ledge and said second ledge trap said head of said fastener so that said first ledge interfaces with said bottom surface of said head of said fastener and said second ledge interfaces with said top surface of said head of said fastener; and iii. said first structural member is a cementitious member that is poured around the connector and said fastener;

iv. said second structural member is a form board and said first surface is an inner surface of said form board;

v. said cementitious member comprises an outer surface that is in abutting relationship with said inner surface of said form board and said cementitious member also comprises a top surface;

vi. said connector additionally comprises an attachment section that has at least some portion protruding out of said cementitious member and is attached to a foot section, said foot section being attached to said first structural member by being at least partially embedded in said cementitious member vii. said first ledge restrains movement of said connector away from said first surface of said second structural member when said cementitious member is being poured around said foot section of said connector;

viii. said second ledge restrains movement of said connector toward said first surface of said second structural member when said cementitious member is being poured around said foot section of said connector.

2. The connection of claim 1, wherein:

a. said shank of said fastener is formed with a tip that is formed to be embedded in said second structural member, said tip being disposed at the opposite end of said shank from said head.

3. The connection of claim 1 wherein:

a. said foot section is substantially planar and further comprises a first side face and a second side face with said first side face being disposed toward said inner surface of said form board.

4. The connection of claim 3 wherein:

a. said foot section further comprises a top end and a bottom end; and b. said attachment section is elongate and substantially planar, is integrally connected to said top end of said foot section, is disposed at a selected angle to said foot section, and said attachment section further comprises:

i. a plurality of restricted openings that are large enough to receive the shanks of nailable fasteners with heads but are too small to receive the heads of nailable fasteners with heads; and c. said connector further comprises a hook section integrally connected to said bottom end of said foot section, said hook section being formed to provide mechanical interlock with said cementitious member.

5. The connection of claim 4 wherein:

a. said restraint opening is formed with an embossment and an adjacent aperture and wherein:

i. said aperture has a first side and a second side, said first ledge being on said first side of said aperture and said second ledge being on said second side of said aperture;

ii. said second ledge is in said embossment and out of the plane of said foot section of said connector; and iii. a portion of said head of said fastener is within said embossment and a portion of said head of said fastener is on said second side face of said foot section.

6. The connection of claim 5 wherein:

a. said aperture is arcuate.

7. The connection of claim 6, wherein:

a. said first side of said arcuate aperture is divided by an open leg that permits said fastener to be driven through said aperture into said second structural member after said connector is placed in a selected position.

8. The connection of claim 4, wherein:

a. said restraint opening is formed with an aperture having a moveable flap, permitting said fastener to be driven through said opening into said second structural member when said flap is open after said connector is placed in a selected position, said flap is moved such that said head of said fastener is held between said first ledge and said second ledge when said flap is closed on said head of said fastener, and one of said first and second ledges is located on said flap.

9. The connection of claim 1 wherein:

a. said restraint opening is formed with an embossment and an adjacent aperture and wherein:

i. said aperture has a first side and a second side, said first ledge being on said first side of said aperture and said second ledge being on said second side of said aperture;

ii. said second ledge is in said embossment; and iii. a portion of said head of said fastener is within said embossment and a portion of said head of said fastener is on said second side face of said foot section.

10. The connection of claim 9 wherein:

a. said aperture is arcuate.

11. The connection of claim 10 wherein:

a. said first side of said arcuate aperture is divided by a open leg that permits said fastener to be driven through said aperture into said second structural member after said connector is placed in a selected position.

12. The connection of claim 1 wherein:

a. said restraint opening is formed with an aperture having a moveable flap, permitting said fastener to be driven through said opening into said second structural member when said flap is open after said connector is placed in a selected position, said flap is moved such that said head of said fastener is held between said first ledge and said second ledge when said flap is closed on said head of said fastener, and one of said first and second ledges is located on said flap.

13. A method of creating the connection of claim 2, comprising:

a. driving said tip of said fastener into said first surface of said second structural member to a selected depth;

b. positioning said restraint opening over said head of said fastener so that said first ledge and said second ledge restrain the head of said fastener, preventing movement of said substantially planar portion of said connector toward and away from said first surface of said second structural member; and c. attaching said connector to said first structural member;

d. pouring said first structural member around said connector and said fastener and allowing it to set such that it has an outer surface that is in abutting relationship with said inner surface of said form board.

* * * * *